US010639658B1

(12) United States Patent
Enriquez

(10) Patent No.: US 10,639,658 B1
(45) **Date of Patent: *May 5, 2020**

(54) SPRAY GUN SYSTEM

(71) Applicant: Robert Enriquez, La Habra, CA (US)

(72) Inventor: Robert Enriquez, La Habra, CA (US)

(73) Assignee: Gemini Holdings, LLC

( * ) Notice: Subject to any disclaimer, the term of this patent is extended or adjusted under 35 U.S.C. 154(b) by 232 days.

This patent is subject to a terminal disclaimer.

(21) Appl. No.: 15/804,783

(22) Filed: Nov. 6, 2017

Related U.S. Application Data

(63) Continuation-in-part of application No. 15/248,841, filed on Aug. 26, 2016, now Pat. No. 9,808,816.

(51) Int. Cl.

| | |
|---|---|
| ***B05B 9/04*** | (2006.01) |
| ***B05B 9/01*** | (2006.01) |
| ***B05B 1/02*** | (2006.01) |
| ***B05B 1/32*** | (2006.01) |
| ***B05D 1/02*** | (2006.01) |
| ***B05B 15/55*** | (2018.01) |
| ***B05B 12/00*** | (2018.01) |
| ***B05B 9/08*** | (2006.01) |

(52) U.S. Cl.
CPC ..... *B05B 9/01* (2013.01); *B05B 1/02* (2013.01); *B05B 1/32* (2013.01); *B05B 9/0805* (2013.01); *B05B 12/002* (2013.01); *B05B 15/55* (2018.02); *B05D 1/02* (2013.01)

(58) Field of Classification Search
None
See application file for complete search history.

(56) References Cited

U.S. PATENT DOCUMENTS

| | | | | |
|---|---|---|---|---|
| 5,669,557 | A * | 9/1997 | Barrett | B05B 7/0815 239/135 |
| 5,887,756 | A * | 3/1999 | Brown | B05B 1/3046 222/136 |
| 6,244,527 | B1 * | 6/2001 | Ferrazza | B05B 15/65 239/600 |
| 7,350,723 | B2 * | 4/2008 | Reedy | B05B 7/2416 239/296 |
| 8,349,110 | B1 * | 1/2013 | Kochis | E04F 21/04 156/71 |

* cited by examiner

*Primary Examiner* — Nathan T Leong
(74) *Attorney, Agent, or Firm* — Advantage IP Law Firm

(57) ABSTRACT

A portable, self-contained, hand-held, spray gun system having spray gun with a handle, barrel, trigger, and an interchangeable cartridge containing a sprayable substance which may flow from the cartridge under pressure through a portion of the barrel past a selectively positionable needle valve and out an exit orifice of a nozzle when the trigger is squeezed allowing a user to spray the pressurized contents of the vessel over a selected surface and stop such spraying activity by releasing the trigger all without the need for a separate power source or motorized compressor.

38 Claims, 32 Drawing Sheets

SPRAY GUN SYSTEM

CROSS-REFERENCE TO OTHER APPLICATIONS

This application is a continuation-in-part of U.S. patent application Ser. No. 15/248,841, now U.S. Pat. No. 9,808,816, filed on Aug. 26, 2016 and entitled Spray Gun System, which is hereby incorporated by reference in its entirety.

BACKGROUND OF THE INVENTION

1. Field of the Invention

The present invention relates to spray gun systems, and more particularly, to portable, self-contained, hand-hold, spray gun systems that operate independently of a motorized compressor for spraying texture and other spray-on substances under pressure onto a joint, article, or surface during coating, cosmetic, finishing, and touch up applications.

2. Background Art

For large drywall construction jobs typically required during new commercial or residential construction or large reconstruction jobs, a commercial mud spray device attached to a large volume hopper is typically used to handle the large volume work. One such example may be found in U.S. Pat. No. 6,793,428 to Lithgow. Such commercial sprayers include a delivery device, a large hopper to hold the drywall compound, and a compressor connected to an electrical power source to provide the pressure force to apply the compound to the desired surface. The delivery device is connected to both the compressor and the hopper with a set of hoses and may be in the form of an elongated barrel that terminates in a blade or trowel for applying and smoothing the mud over the large surface area. However, cleaning and moving this type of contraption is a long and difficult process and assembling and using such contraption for smaller jobs is impractical and inefficient.

In contrast to the large volume commercial hopper, spray cans similar in construction to a conventional paint spray aerosol can but loaded with drywall texture material or acoustic (popcorn) material may be used for smaller surface applications. One example of such an aerosol can may be found in U.S. Pat. No. 6,276,570 to Stern et al. which depicts an aerosol type can with a conventional push button spray nozzle into which an elongated straw nozzle may be inserted. However, given the proximity of the finger to the spray nozzle outlet, it is common to wind up with a significant amount of material on the user's hands. Such nozzles are also known to clog frequently. Moreover, the spray button alone lacks in directional and volume control and precision. Adding the elongated straw does assist in the directionality of the spray emission but such straw extensions are notoriously poor at staying engaged with the spray button outlet thus limiting their effectiveness. Such elongated straw nozzles are unsuitable for many spraying applications as well. Given the construction of the can, highly aerated, less viscous materials may be sprayed but thicker more viscous fluids have difficulty flowing upwardly out of the can and out the nozzle. Typically, these aerosol cans include an internal dip tube that prevents thicker fluids from achieving an adequate flow rate and often leads to waste as not all the contents are removed from the can.

A variation of this aerosol can approach may be found in U.S. Pat. No. 8,042,713 to Greer et al. wherein the nozzle is modified to incorporate an enlarged spray actuator with a set of opposing flanges for a better purchase when depressing the spray nozzle to release the pressurized contents in the can, including acoustic texture or stucco material. However, the same precision issue arises with such a construction. Despite the modification of the nozzle area, these type of cans also typically include a similar internal dip tube and have the accompanying drawbacks.

Another old-fashioned approach to a spray on system is a hand-pumped delivery device similar to an old fashioned bug spray gun with a plunger forcing the sprayable substance out through a nozzle. However, these hand-pumped devices require both hands to operate and frequently result in a jerky motion leading to inaccurate application of the substance. In addition, the pressure forcing out the substance is generally erratic leading to poor results.

In a variation of a large commercial hopper construct but in the paint spraying field, paint spray guns have been tried with a smaller attachable container such as that in U.S. Pat. No. 7,922,107 to Fox. However, this variety does not incorporate a pressurized cartridge and still relies on an air hose and motorized compressor to deliver the air supply similar to the commercial mud hopper. Thus, such system is not self-contained, not completely hand-held, and not very portable in that the user would not carry the entire spray system around while working. Instead, the compressor is stationary while the user works with the spray gun. The hose length between the compressor and the spray gun limits the user's freedom of movement requiring the heavy compressor to be moved frequently when covering a large area. The long hose between the compressor and the spray gun allows for some freedom of movement but often get in the away and are a tripping hazard. For cosmetic and touch up work, the use of a large compressor attached by a hose is too time consuming and inefficient for the size of the job. The hinged cartridge loading system also adds expense to the manufacture of the spray gun. In this approach as explained in the Fox patent, the cartridge is loaded in an inverted configuration with a rearward cant wherein the top of the inverted cartridge is tilted toward the rear of the spray gun. While this orientation has some uses, the rearward cant often results in starving the spray feed when working overhead such as when spraying a ceiling. Starving the spray feed causes sputtering or gaps in the spray application resulting in undesirable spray patterns.

A variation of the prior attempt by Fox may be found in U.S. Pat. No. 7,350,723 to Reedy wherein a cordless, self-contained, handheld spray gun is described. In this device, a source of pressurized gas is either in the form of a self-contained, handle mounted, battery powered air compressor for charging an attached cartridge, a separate cartridge filled with pressurized gas (CO2 compressed gas cartridge), or, as a third alternative, a conventional air compressor using the convention hose and a bypass valve. The third alternative clearly has the same drawbacks as the Fox device. If using the self-contained battery operated air pressure source, the air container needs to be initially pressurized if not already compressed before use. Thus, this type of device needs a self-contained power source like a battery (acting more like a cordless screwdriver) in order to power up and prime the system which adds time to the overall setup and use. While the fluid container is gravity fed, the fluid and air are initially maintained in separate fluid and air containers, respectively, requiring additional discrete paint containers and gas cartridges as well as additional plumbing for connecting the pressure source to the spray on substance source and then to the spray gun outlet. Two filling processes are also required, one for the gas and one for the paint. The overall construction of providing such a complex device adds to the overall cost and an additional likelihood of failure as well due to the added components and complexity. The weight of the added battery and motor also adds to premature user fatigue. The device, while primarily focused on spray paint applications, does allow for applications of different viscosity, such as paints, primers, stains, varnishes, sealants but does not address the difficulties of applying textures such as drywall compound or mud. A similar approach using a battery operated motor to provide an air blower is shown in U.S. Pat. No. 8,025,243 and suffers from the same drawbacks regarding the added weight of the battery and motor.

Another approach may be found in U.S. Pat. No. 5,887,756 to Brown. Brown generally discloses a dispensing gun for fluent products such as adhesives and sealants. The gun may be coupled to an inverted cartridge, oriented with the same rearward cant as in Fox above or in an upright configuration coupled to the bottom of the dispensing gun. Thus, the rearward cant inverted configuration has the same drawbacks as in Fox. The elongated nozzle tip is better suited for application of adhesives or caulking where a parrow bead is sought. The user is also restricted to the provided tip and thus this gun style is extremely limited in its applications.

Yet another approach may be found in EP 1867396 B1 to Michelot. Michelot generally discloses a spray gun for painting using aerosol cartridges. The pressurized cartridge is mounted in an upright configuration from the bottom of the spray gun. While a dip tube does not appear to be used, extracting higher viscosity fluids such as drywall compound is not disclosed and would not be practical using such a spray gun. In practice, the gas is likely rise to the top of the cartridge and escape first leaving a heavier viscous fluid behind and rendering the spray useless. Thus, much of the sprayable product may be wasted.

In light of the foregoing, while many of these prior approaches have their uses and limited applications, they suffer from a variety of drawbacks. For example, the incorporation of a separate compressor attached by a pressure hose requires the transportation of a number of components, including a heavy compressor, and limits freedom of movement. In addition, a compressor is unlikely to be needed when addressing touch or cosmetic applications. Other spray guns attempt to remove the remote compressor and install a small motorized compressor run by a battery right into the handle of the gun. However, this adds considerable weight and expense to the spray gun since the spray gun carries the sprayable product, a motor, and a battery contributing to early arm fatigue inhibiting the user from working for longer periods.

Other approaches involve a dedicated spray paint and dedicate gas cartridge that require two separate plumbing lines merging into a single line eventually before exiting the spray gun. This cartridge duplication adds significantly to the overall costs and complexity of the spray gun. Yet, other devices employing an upright canister often requiring a dip tube but fail to draw out all of the sprayable product leading to a waste of product and cannot be used in an inverted configuration. These drawbacks are exacerbated when the sprayable product has a high viscosity and would not be practical in most instances. Along these lines, devices dedicated to spraying paint or low viscosity products do not take into the account the difficulties of spraying drywall texture, also referred to as mud. The heavier viscosity of the drywall texture generally requires a different approach than devices constructed to spray a fine mist of atomized paint.

While the foregoing devices may perform well under certain conditions and with certain substances, what is needed is a convenient portable, hand-held, relatively mess-free, lightweight, self-contained spray gun system incorporating replaceable pressurized cartridges containing the desired sprayable substance and being especially useful for precision finish work, including overhead work, required for topical and cosmetic jobs, while reducing set up time and allowing greater freedom of movement.

SUMMARY OF THE INVENTION

In accordance with the principles of the present invention, a spray gun system for texturing a surface may be provided in the form of a spray gun body having a handle and a main barrel defining a passageway connecting an inlet port to a spray outlet and a spray valve projecting at least partially through the main barrel of the spray gun body and constructed to travel between a first position closing the spray outlet and a second position at least partially opening the spray outlet and a pre-filled, pressurized cartridge at least partially filled with a volume of sprayable material and including a release valve, the cartridge being releasably engaged with the spray gun body to open the release valve and allow at least a portion of the sprayable material to enter the passageway through the inlet port wherein a trigger coupled to the spray valve is constructed to transition the spray valve between the first position and the second position allowing at least a portion of the sprayable material to be sprayed out onto the surface through the spray outlet.

In another aspect of this system, spray gun system includes an inverted pressurized cartridge filled with texture material avoiding the need for an internal dip tube while relying on both gravity and pressure to evacuate the cartridge.

In yet another aspect of the system, the top end of the inverted cartridge is canted forward toward the spray outlet at the front of the spray gun body to reduce instances of sprayable substance starvation such as when applying the texture to an overhead surface.

Another aspect of the system is the incorporation of a spray tip adapter and a variety of spray tips for applying different spray effects and patterns.

In another embodiment, the main barrel of the spray gun apparatus includes a narrowed pre-staging chamber to reduce buildup of the sprayable material as the material exits the spray nozzle.

In another embodiment, the spray gun system is capable of spraying both orange peel and knockdown texture patterns from the same pressurized cartridge.

Methods for spraying a pattern on a desired surface using the assembled spray gun system are also disclosed herein.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENTS

Figure 1:
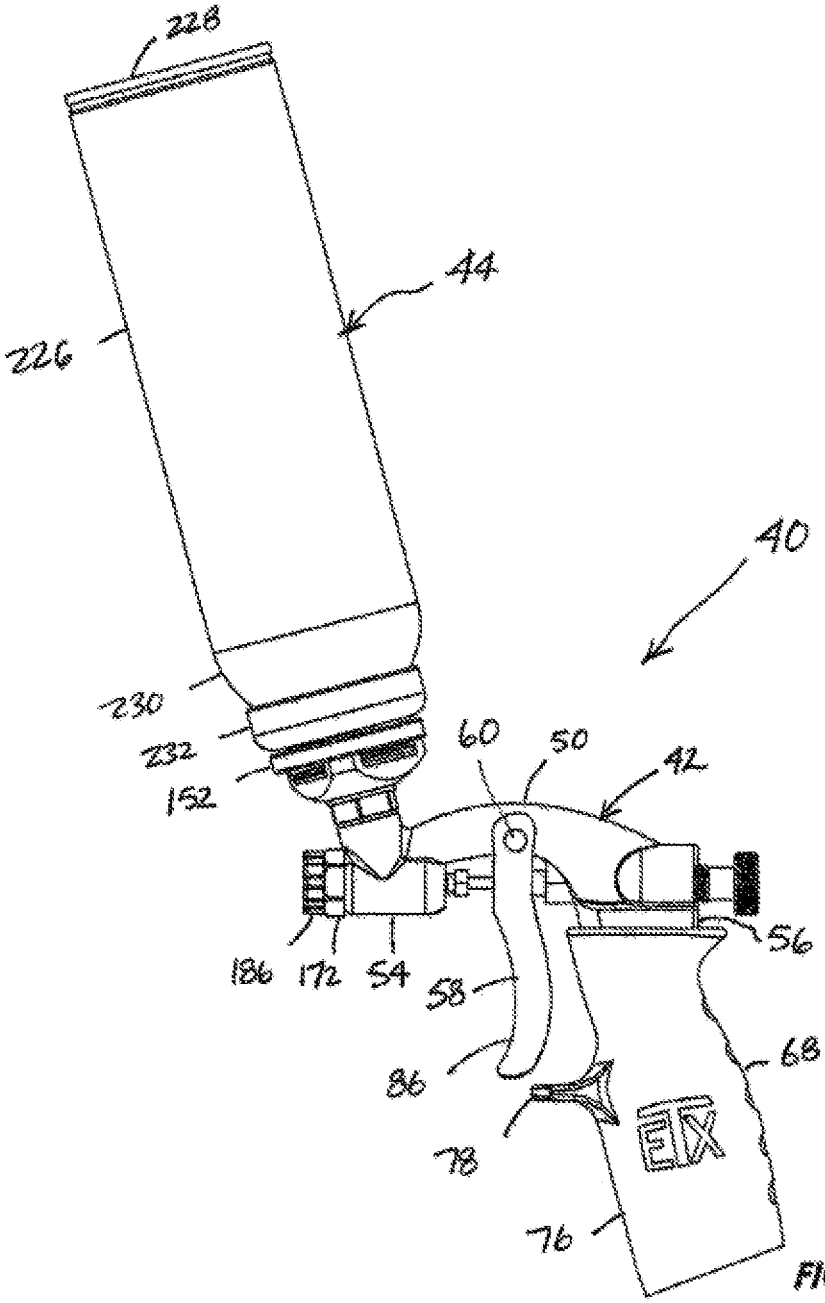
FIG. 1 is a right side view of an exemplary embodiment of a spray gun system constructed in accordance with the principles of the present invention, the left side being substantially identical.
Figure 2:
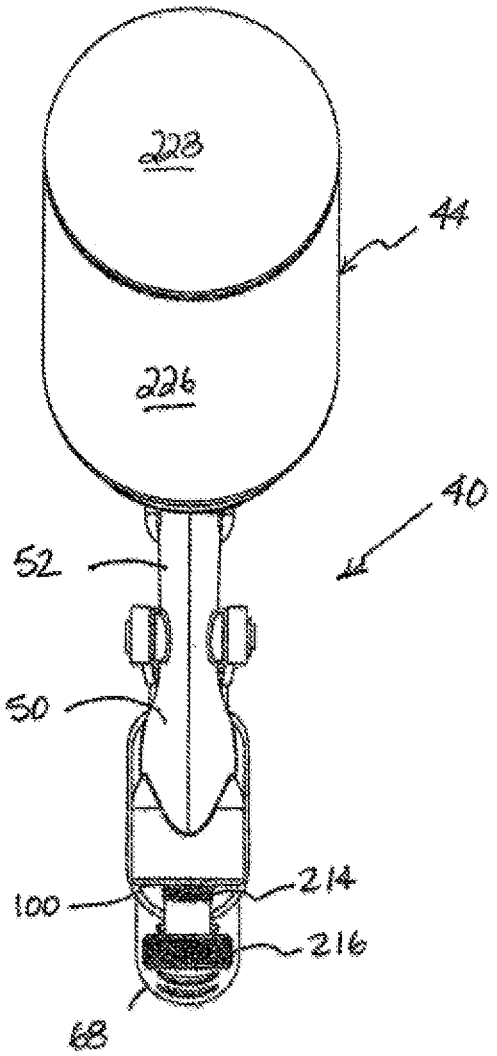
FIG. 2 is a top view of the spray gun system of FIG. 1.
Figure 3:
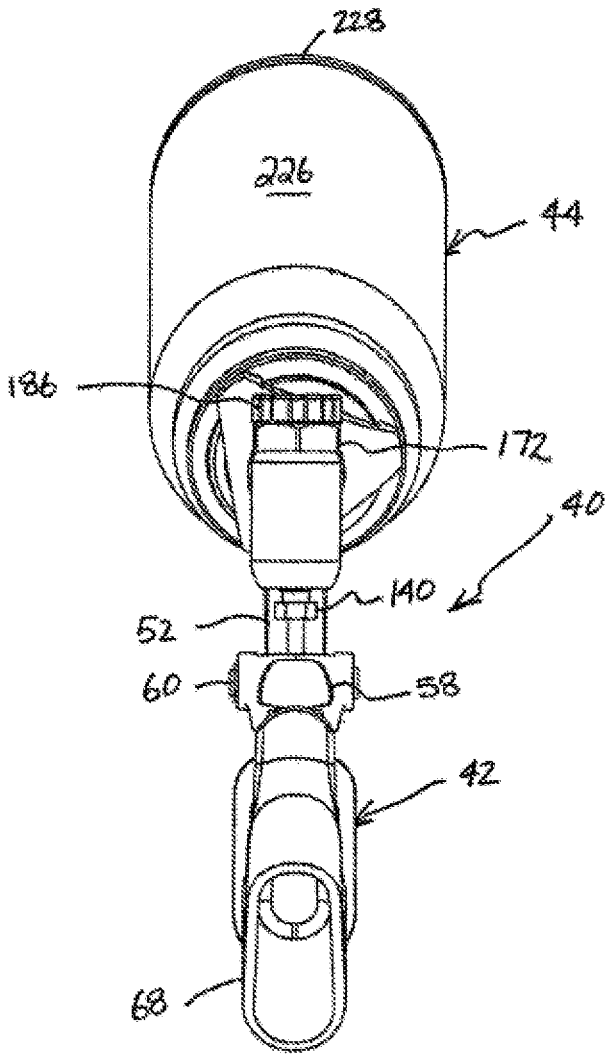
FIG. 3 is a bottom view of the spray gun system of FIG. 1.
Figure 4:
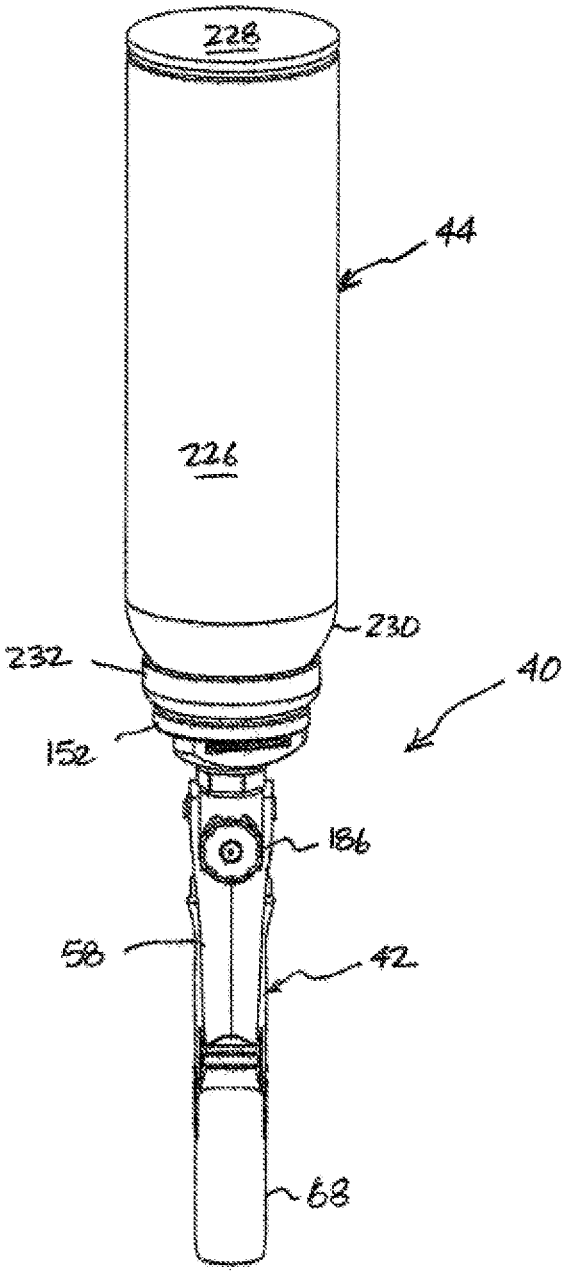
FIG. 4 is a front view of the spray gun system of FIG. 1.
Figure 5:
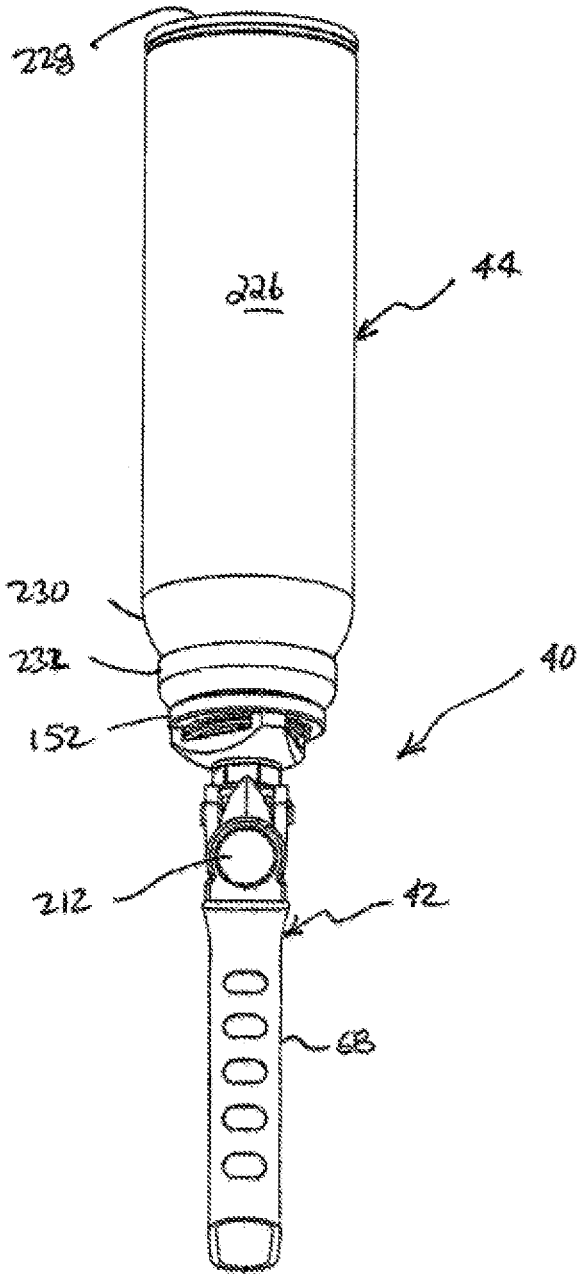
FIG. 5 is a rear view of the spray gun system of FIG. 1.
Figure 6:
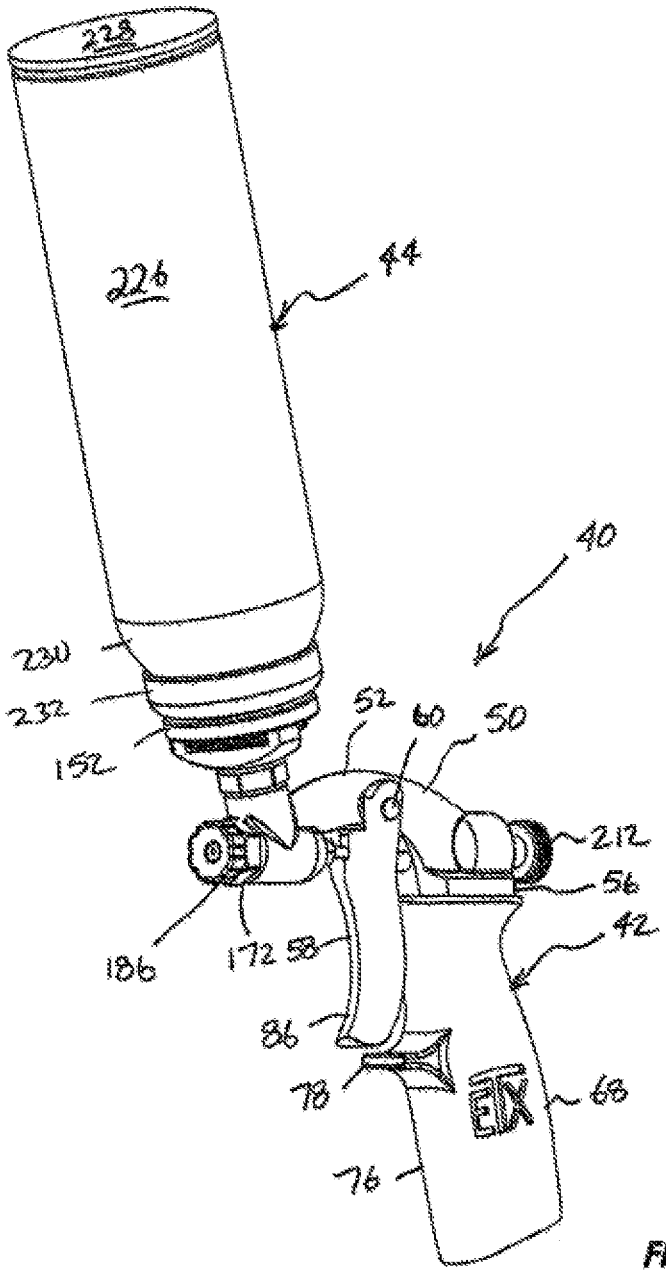
FIG. 6 is a front right perspective view of the spray gun system of FIG. 1.
Figure 7:
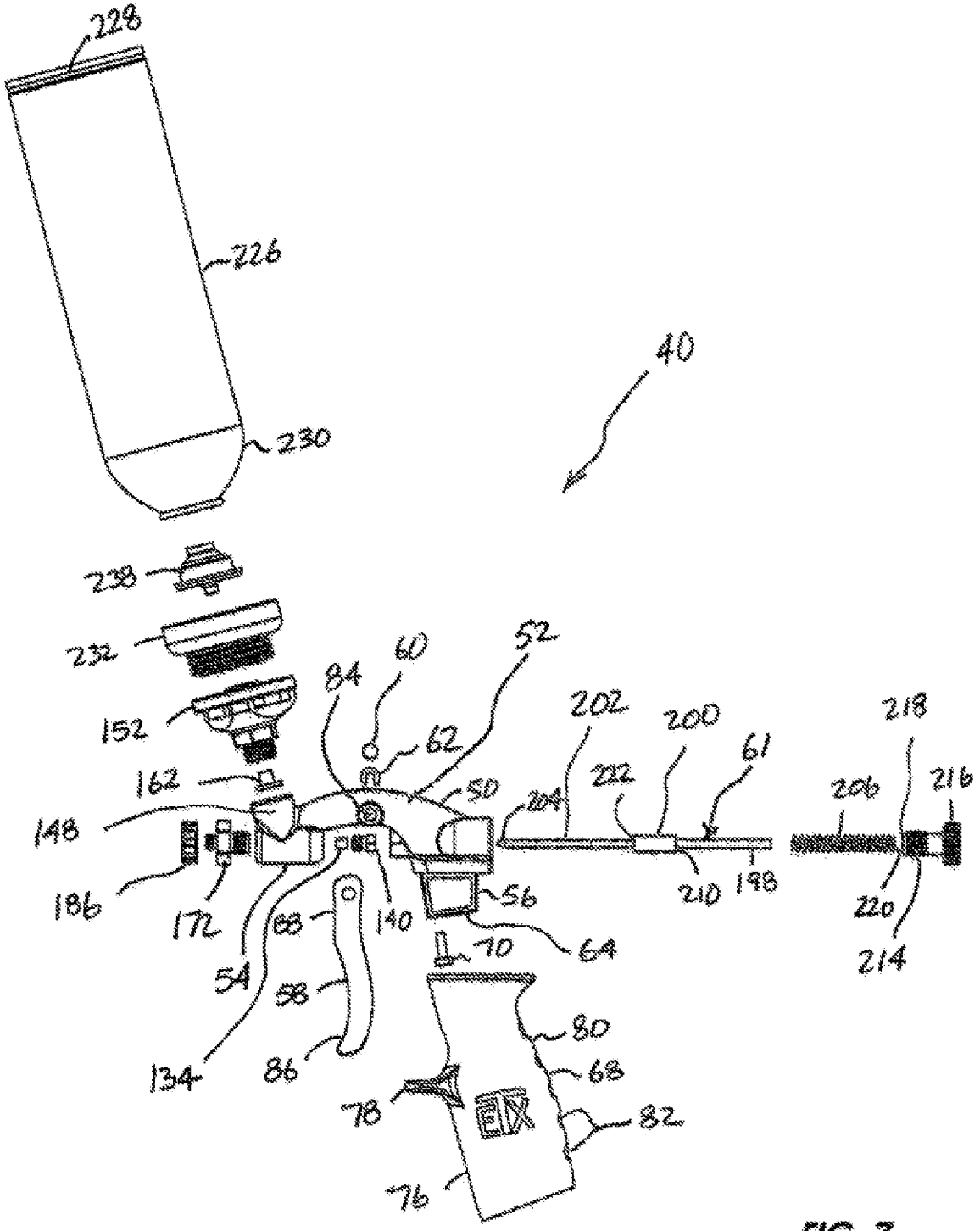
FIG. 7 is an exploded right side view of the spray gun system of FIG. 1.

Overview of the Spray Gun System:

With reference to the figures, an exemplary embodiment of a spray gun system, generally designated 40 (FIGS. 1-8, 12, and 14), is described herein. In general terms, the spray gun system 40 combines the versatility, maneuverability, and precision of a spray gun, generally designated 42, with an interchangeable pressurized cartridge, generally designated 44, to provide a self-contained, portable, hand-held, pressurized spraying system for applying a volume of contents, generally designated 46 (FIGS. 10 and 12), stored in the cartridge against a surface 48 (FIG. 14) such as a wall, ceiling, article, surface, or joint to be coated, sprayed, or textured, all without the need for an external power source, motorized compressor, or other external pressurizing source. Additional description concerning this spray gun system 40 follows.

Exemplary Spray Gun:

With continued reference to FIGS. 1-10, the spray gun 42 (also referred to as spray gun apparatus, content delivery device, and/or directional substance delivery device) generally has a spray gun body 50 with a raised arch central section or rib 52, when viewed from the side as in FIG. 1, that extends into a forward main barrel section 54 and an opposing rearward handle mounting section 56 spaced apart from the main barrel section. A trigger 58 is pivotally coupled to the central section using a trigger retainer pin 60 (FIGS. 1 and 7-9A) passing through the central section. The trigger may be hand squeezed to actuate a spray valve 61 (FIGS. 7-8, 9A, and 10-13) from a fully closed position as in FIGS. 10-11 to a fully open position as in FIGS. 12-13 and released back to the fully closed position. The amount of trigger squeezing may be used to vary the amount of texture material exiting the spray gun under pressure as will be described below. A retainer pin snap ring 62 (FIGS. 7-9A) prevents the trigger retainer pin 60 from slipping out of the spray gun body. 50 and allowing the trigger to be separated from the spray gun body.

The handle mounting section, generally designated 56 (FIGS. 1, 7-9A, 10 and 12), includes a handle insert 64 inserted into a complementary slot 66 (FIGS. 8-9A) in the handle 68 to form a joint similar to a tenon and mortise joint used for wooden structures. The handle may be hollowed out to provide a lighter structure and use less material as shown in FIGS. 3, 9A, 10, and 12. A screw 70 (FIGS. 7-9A, 10 and 12) fastens the handle 68 to the handle mounting section 56 by passing through a bore 72 (FIG. 9A) in the handle and engaging a screw receptacle 74 with complementary threads projecting into the bottom surface of the handle mounting section.

With continued reference to FIGS. 1, 6-7, and 9A, the front surface 76 of the handle 68 includes a finger guard 78 projecting generally horizontally from the front surface 76 to keep the user's hand from migrating up the handle with repeated squeezing. On the opposing rear surface 80 of the handle includes a set of dimples (or alternatively, ridges) 82 (FIG. 7) for adding a textured surface to enhance the grip surface of the handle.

Turning back to FIGS. 1 and 7-10, the central rib section 52 includes a through bore 84 (FIGS. 7-9A and 10) passing laterally all the way through the spray gun body 50 from the right side of the gun body to the left side of the gun body. The trigger 58 includes a lower end elongated grip 86, an intermediate valve engagement section 88, and an upper pair of spaced apart arms 90*a*, 90*b* with respective holes 92*a*, 92*b*. The arms 90*a*, 90*b* slip over and engage the sides of the central rib section 52 and align the holes 92*a*, 92*b* with opposing sides of the through bore 84 for receipt of the trigger retainer pin 60 to capture the trigger 58. The trigger retainer snap ring 62 may be inserted over a reduced diameter section of the trigger retainer pin to secure the trigger retainer pin and pivotally retain the captured trigger 58 on the spray gun body 50.

Figure 8:
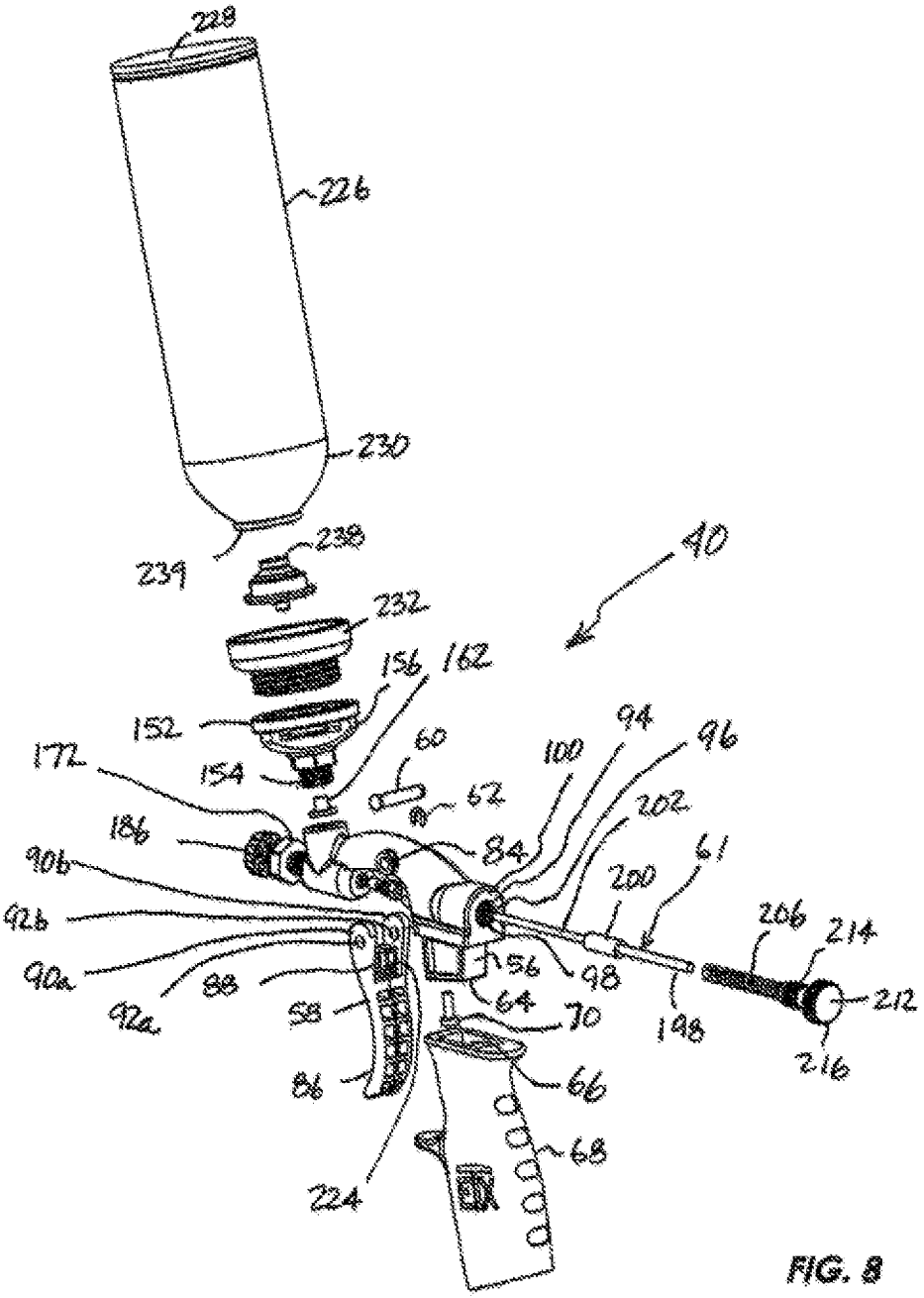
FIG. 8 is a rear perspective exploded view of the spray gun of FIG. 7.
Figure 9A:
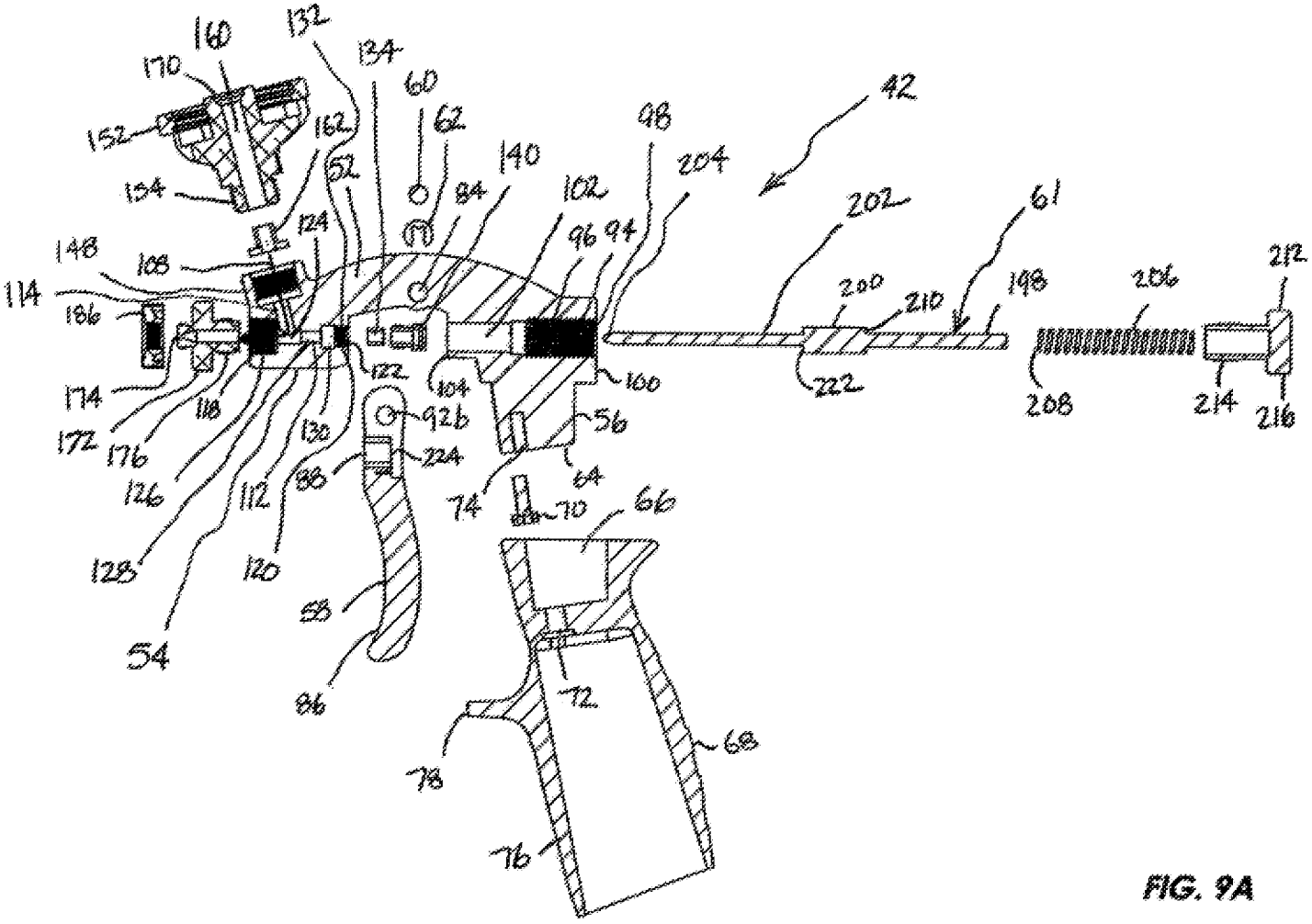
FIG. 9A is a cross sectional exploded view, in enlarged scale, of the spray gun apparatus of FIG. 7 separated from the cartridge.

Referring to FIGS. 8-9A, the handle mounting section 56 includes an adjustment bore 94 having a rear threaded section 96 projecting into the spray gun body 50 above the handle insert 64 from a threaded opening 98 starting at the rear surface 100 of the spray gun body 50 and transitioning at about the half-way point to an unthreaded bore 102 terminating in a parallel opening 104 appearing in the front surface 106 of the handle mounting section and beneath the central rib section 52.

Referring now to FIGS. 1 and 7-9A, and 10-13, the forward barrel section 54 defines a passageway 108 that forms the main flow path for evacuating the contents 46 (FIG. 10) of the cartridge 44 under pressure out through a spray outlet 110 (also referred to as spray port, primary spray port, or nozzle adapter port) and any attached spray tips, spray heads, extended spray outlets, spray orifices, or spray profiles. The passageway 108 includes a primary leg 112 and a secondary leg 114 generally oriented at an oblique angle to the primary leg. In this specific embodiment, the secondary leg is tilted forward toward the spray outlet 110 with a centerline projecting through the secondary leg being tilted forward from a centerline projecting through primary leg. The primary leg 112 extends in a generally horizontal direction as viewed in FIGS. 9A and 10-13 from the rear face 116 to the front face 118 of the main barrel section. The primary leg is divided into a rear collet receiving section 120 with an opening 122 in the rear face 116 of the main barrel, an intermediate junction section 124, and an enlarged threaded section 126 terminating at the front face 118 of the main barrel section 54 with the spray outlet 110.

Still referring to FIG. 9A, the rear collet receiving section 120 includes a forward unthreaded section 128, a central enlarged diameter section 130, and a rear reduced diameter threaded section 132. A needle valve collet bushing 134 is inserted into the rear collet receiving section 120 and seated with the leading edge 136 of the bushing against the rear surface 138 of the forward unthreaded section. Following the bushing is needle valve collet seal 140 with a front threaded region 142 for engaging the internal threads of the rear reduced diameter threaded section 130. The collet seal further includes a rear sealing section 144 for sealing off the rear opening 122 of the primary leg 112 of the passageway 108 when the spray valve 61 is in place.

In this exemplary embodiment, the intermediate junction section 124 (FIGS. 11 and 13) is where the primary leg 112 meets the secondary leg 114 at approximately a seventy-five degree acute angle (alpha) measured at the intersection of the primary leg center line and secondary leg center line and facing the front of the spray gun body 50. From another angle, this forward cant measures approximately fifteen degrees canted forward from a vertical plane passing through the junction of the primary and secondary legs. While the forward cant or angular orientation of the inverted cartridge is preferred, the particular angle is not meant to be limiting and a wide range of angles resulting in a forward leaning inverted cartridge 44 may be used. Different angles may provide a variety of balance points preferred by individual users. While a rearward cant is not precluded and may be useful in some instances, the forward cant has been found to have a wider range of application, especially when spraying overhead surfaces. It is also preferred, but not required, that the spray gun with the inverted cartridge attached is self-supporting with the gun in an upright position on a flat surface. The secondary leg 114 includes a first content staging section 146 that projects at an acute angle from the primary leg 112 and transitions into an enlarged cartridge seat coupling section 148 that ends in an uppermost forward canted surface 150.

Referring now to FIGS. 1, 3-9A, 10, and 12-13, coupled to the spray gun body 50 is a cartridge seat 152 for removably engaging the interchangeable pressure vessel 44. The cartridge seat includes a post 154 with external threads for engaging complementary threads on the interior of the cartridge seat coupling section 148. The post flares outwardly into a ringed seat 156 with an internal threaded region 158 for engaging the pressure vessel 44. A passthrough bore 160 projects through the cartridge seat 152 with the innermost portion slip fitting over a cartridge seat seal 162 (FIGS. 9A, 11) interposed between the innermost end of the post 154 and innermost surface 164 of the enlarged threaded section 148. The cartridge seat seal includes a cylindrical insert 166 that slips into the lower end of the passthrough bore 160 and a surrounding flange 168 that inhibits pressurized contents from leaking out through the threaded cartridge seat coupling section 148. In this exemplary embodiment, it is preferred that the diameter of the passthrough bore 160 matches or closely matches the diameter openings in the cartridge seat seal 162 and secondary leg 114 to reduce any buildup of the contents evacuating the cartridge 44. The uppermost end of the passthrough bore 160 of the cartridge seat 152 includes a valve depressing cone 170 with a shoulder and opening for engaging a male relief pressure valve of the cartridge 44 as discussed below.

Figure 9B:
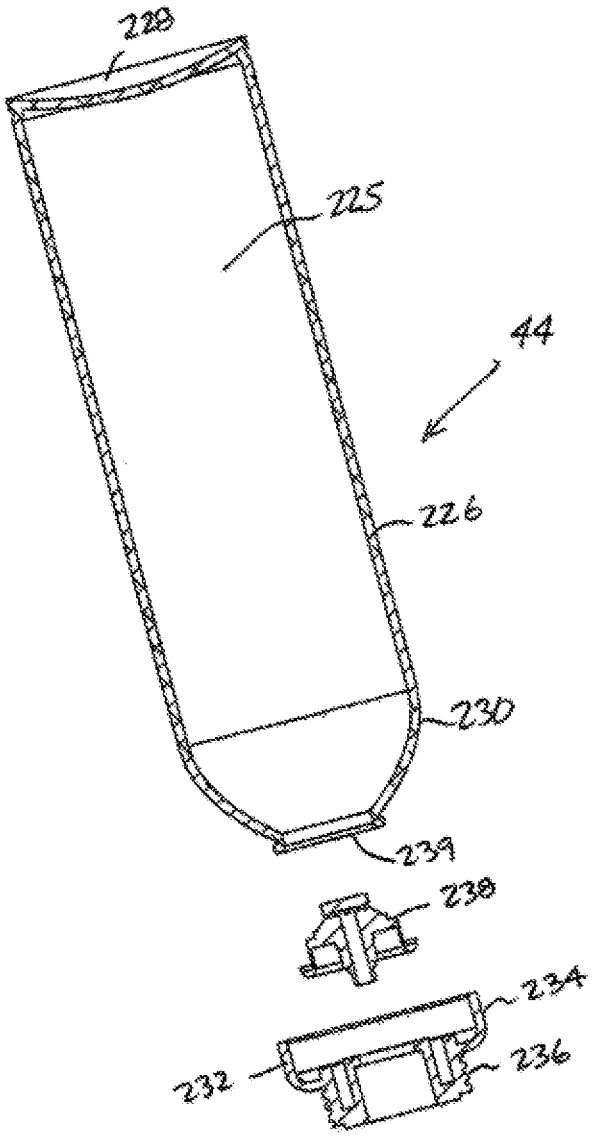
FIG. 9B is a cross sectional exploded view of the cartridge of FIG. 7 separated from the spray gun apparatus.
Figure 10:
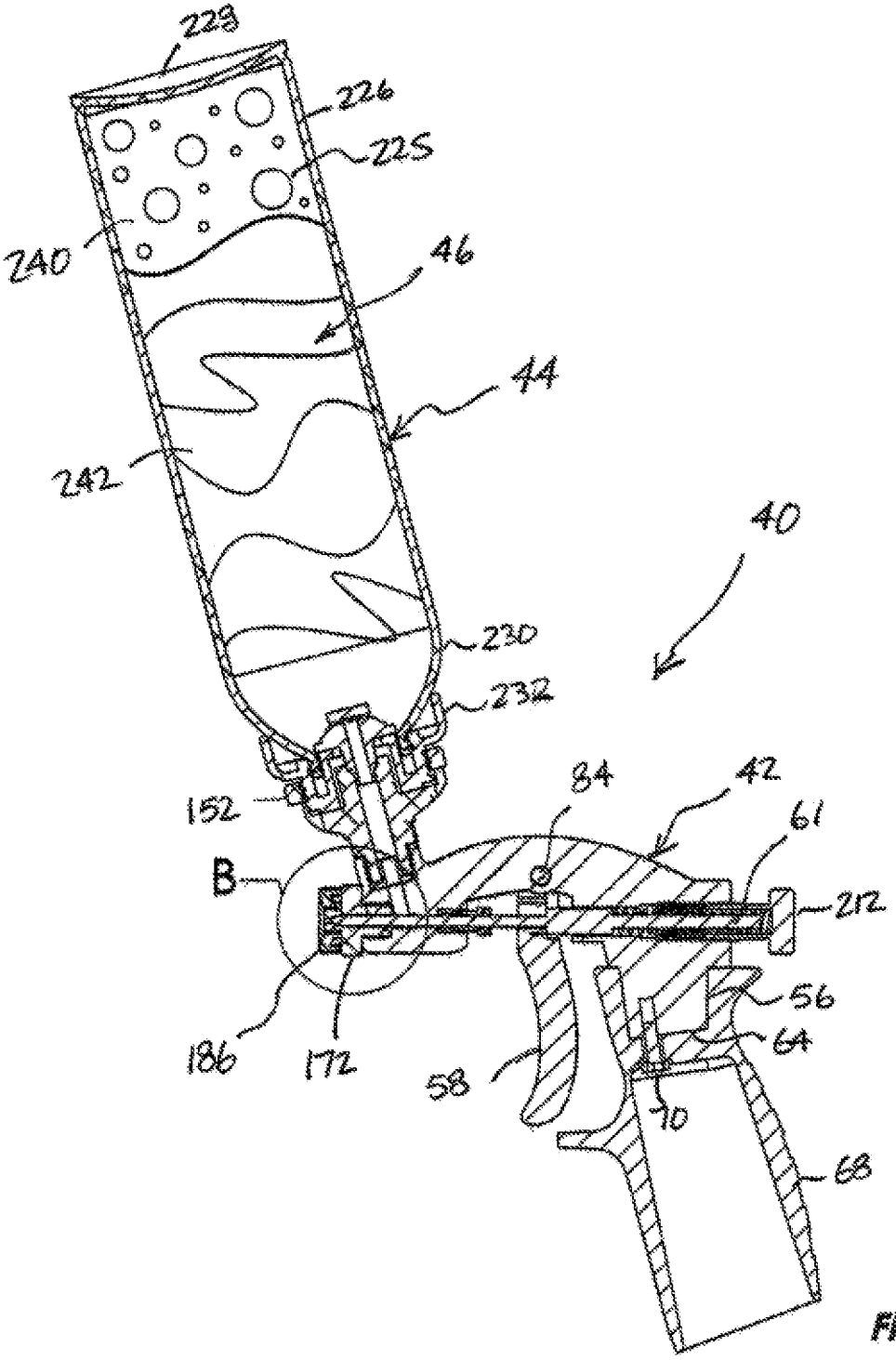
FIG. 10 is a cross sectional view of the assembled spray gun system of FIG. 1 with the cartridge pressure relief valve in an open configuration and the spray valve in a closed configuration with the trigger in a released position.
Figure 11:
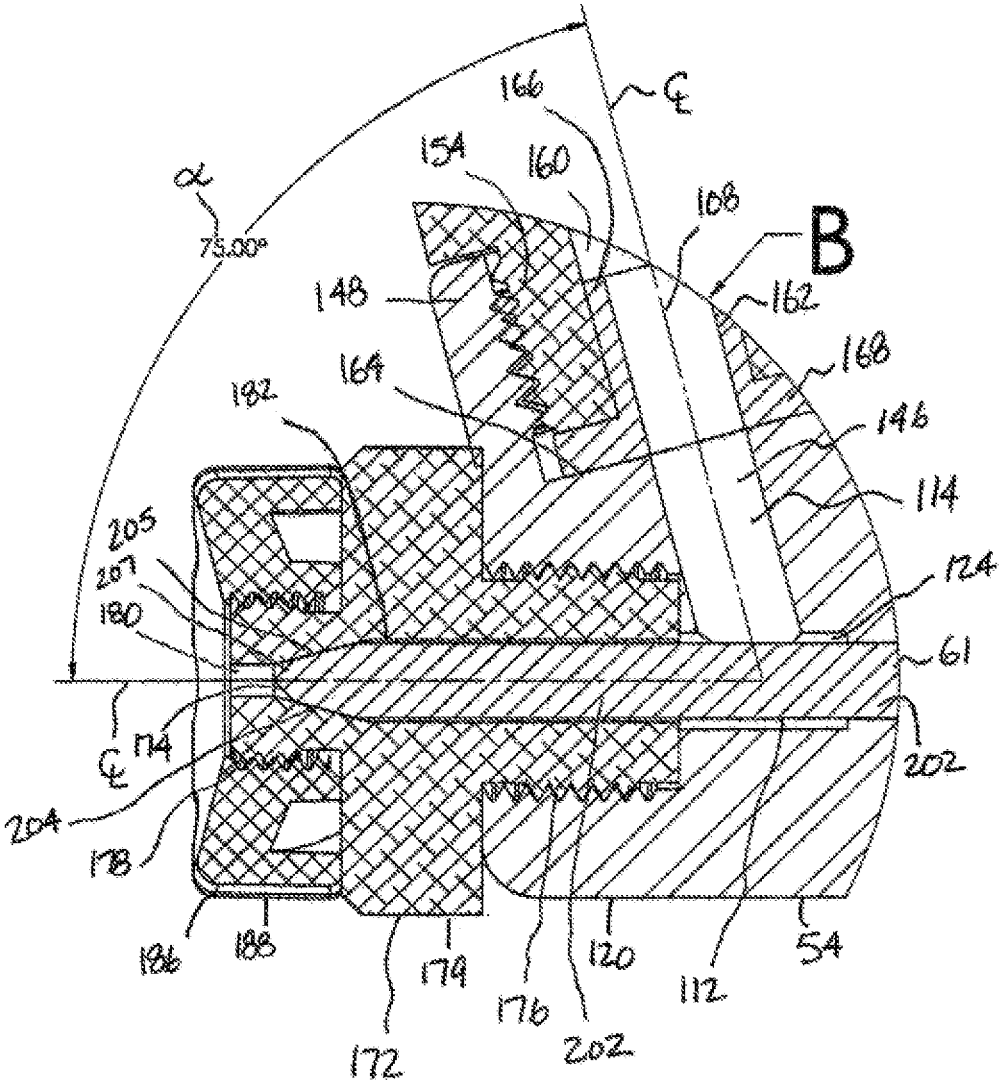
FIG. 11 is a close up view of the closed spray valve configuration taken from the circle B of FIG. 10.
Figure 12:
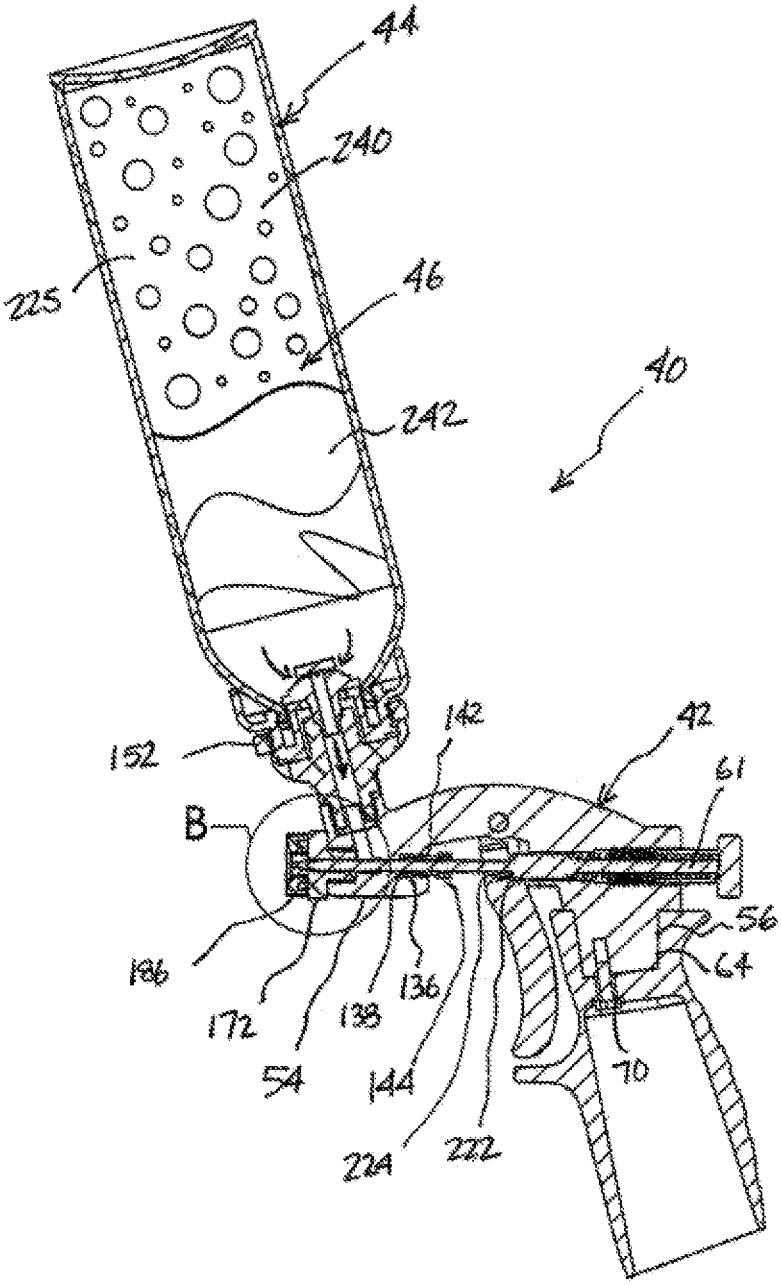
FIG. 12 is a similar view to FIG. 10 with the spray valve in an open configuration and the trigger partially engaged.
Figure 13:
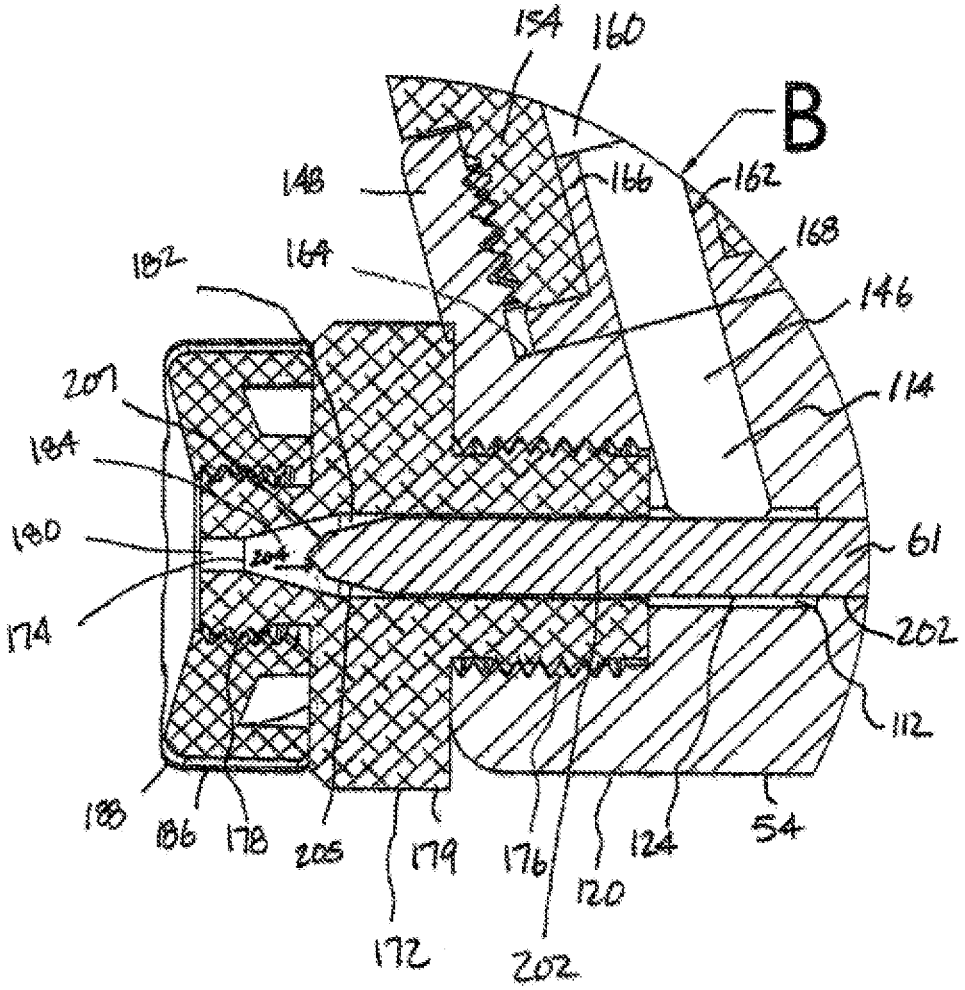
FIG. 13 is a close up view of the open spray valve configuration taken from the circle B of FIG. 12.

Referring now to FIGS. 1, 7-9A, and 10-13, the enlarged threaded section 126 of the main barrel 54 receives an interchangeable threaded spray tip adapter 172 with a spray tip adapter outlet 174 (alternative, secondary, or auxiliary spray port or spray outlet) and a threaded rear insert 176 with external threads for engaging the complementary internal threads of the enlarged threaded section 120 of the spray gun body 50. The forward end of the spray tip adapter also includes an external threaded extension 178 surrounding the spray nozzle outlet 174. Between the threaded sections 176 and 178 is a hexagonal face 179 to facilitate threading the spray tip adapter 172 into a tightly fitting engagement with the main barrel 54 of the spray gun 42. An internal central bore 180 extends throughout the spray tip adapter and aligns with the junction section 124 of the primary leg 112 of the main barrel 54 to extend the content evacuation passageway 108 out through the spray tip adapter 172. The rear section 182 of the central bore 180 is the same or substantially the same diameter as the junction section 124 of the primary leg 112. In this exemplary embodiment as shown in FIGS. 11 and 13, the rear section 182 of the central bore 180 of the spray tip adapter 172 is slightly reduced in diameter than the diameter of the junction section of the primary leg. The forward end of the central bore 180 tapers inwardly from the rear section 182 to form an internal needle valve seat 184 leading to the spray tip adapter outlet 174.

Figure 15A:
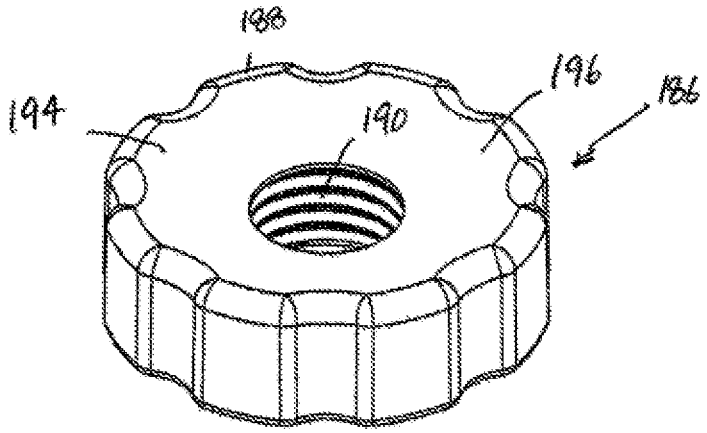
FIGS. 15A-C depict an upper perspective (FIG. 15A), side (FIG. 15B), and side cross-sectional view (FIG. 15C) taken along lines A-A of FIG. 15B of an exemplary thread protector or orange peel spray tip for use with the spray gun system in accordance with the principles of the present invention.
Figure 15B:
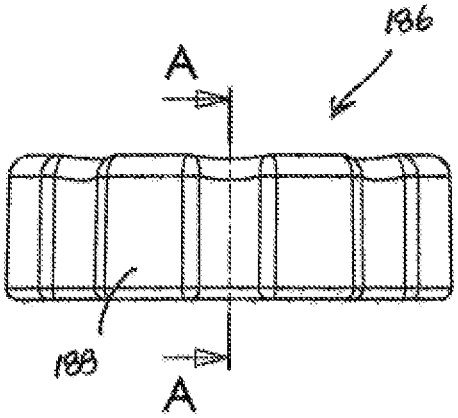
Figure 15C:
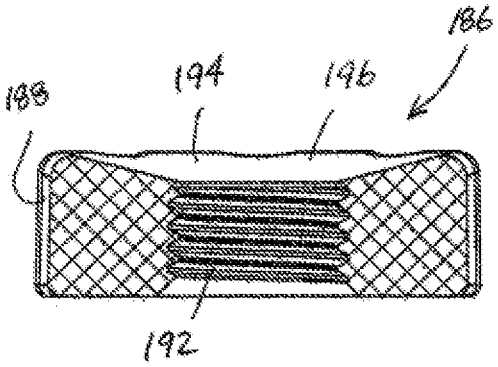

Referring now to FIGS. 1, 8, 9A, and 15A-C, screwed onto the threaded forward adapter tip extension 178 is a spray tip protector 186 with a generally collar or ring-shaped body dimensioned to fit over and engage the spray tip adapter tip extension. The external surface 188 of the spray tip protector may be knurled (FIG. 8) or dimpled (FIGS. 15A-15B) to provide a better gripping surface. In this exemplary embodiment, the spray tip protector 186 includes a central bore 190 with an enlarged aft (rear) end 192 having internal threads to engage the complementary external threads of the forward extension 178 of the spray tip adapter 172. The outermost end of the spray tip protector 186 presents a spray tip profile 194 or shaped spray outlet (auxiliary, secondary, or alternative) that may take a variety of shapes for providing alternative spray patterns. For example, the spray tip profile 194 as shown in FIG. 15C is an enlarged truncated conical opening 196 starting at the outer end of the threaded rear section 192 and expanding outwardly toward the sidewalls of the spray tip protector body. Such a spray profile has been found to be particularly useful in spraying an orange peel pattern and that may also transition to a knock down pattern depending on the position of the trigger. Spray profiles are generally shown in cross section as shown in FIGS. 11, 13, 15C, 16C, 17B, 18C, 19B, 20B, 21B, and 22B and generally consist of the spray outlet shape of the adapter 172, protector 186, or exemplary interchangeable spray tips discussed below extending from the threaded section that couples the component to the spray gun main barrel or spray tip adapter. Alternatively, the spray tip protector 186 may be constructed without a spray outlet and merely provide a protective cap for the external threads 178 of the spray tip adapter. In such case, the user would remove the spray tip protector 186, if used, prior to use and rely simply on the spray tip profile provided by the spray tip adapter 172.

It will be appreciated that, depending on the inclusion of the spray tip adapter 172, and/or spray tip protector 186 with spray tip profile 194 that the content evacuation passageway 108 may be defined as starting within the cartridge 44 and continuing on through the secondary leg 114 and entering the primary leg 112 of the main barrel to exit out through the enlarged main barrel front spray outlet 110, or the outlet 174 of the spray tip adapter 172, or through the conical opening 196 of the spray tip protector 186. Thus, the spray outlet may be considered as the spray outlet 110, spray outlet 174, or spray outlet 194 depending on which components are attached to the main barrel 50. In general terms, the spray outlet is generally that exterior portion of the spray gun, with or without attachments, where the contents 46 exit and are directed to a surface to be sprayed.

Referring now to FIGS. 7-9A, and 10-13, in this exemplary embodiment, the spray valve 61 is in the form of a needle valve that passes through the spray gun body 50 of the spray gun apparatus 42. The needle valve 61 includes an elongated rear cylindrical extension 198, an enlarged central trigger engaging catch 200, and a forward elongated cylindrical extension 202 terminating in a needle nose tip 204. The needle valve 61 is inserted, needle nose tip first, through rear orifice 98 of the handle mounting section 56, on through the handle mounting section and through the needle valve collet seal 140 and bushing 134 of the main barrel section 54 until the needle nose tip 204 is seated against the sidewalls of the needle valve seat 184 to close off the content evacuation passageway 108 as best shown in FIGS. 10-11.

Still referring to FIGS. 7-9A and 10-13, a coil compression spring 206 is slid over the rear elongated section 202 of the needle valve 61 with the forward most end 208 of the spring 206 abutting the rearmost end 210 of the catch 200. The spring biases the needle valve into a closed configuration as shown in FIGS. 10-11. Compressing the spring is an adjustment knob 212 that includes an external threaded section 214 that engages the complementary internal threads 96 of the adjustment bore 94. The adjustment knob further includes an enlarged flange 216 with a knurled outer surface to provide an improved purchase area to grip when twisting. The front end 218 of the adjustment knob abuts or captures the rear end 220 of the compression spring 206. As would be appreciated by one of ordinary skill in the art, when the adjustment knob is turned, the compressive force on the compression spring is varied which, in turn, adjusts the squeezing resistance of the trigger.

Referring now to FIGS. 7-9A and 12, the front end 222 of the catch 200 of the needle valve 61 abuts the catch engagement surface 224 recessed from the rear surface of the trigger 58. When front surface 86 of the trigger 58 is squeezed, the catch engagement surface 224 pushes against the front end 222 of the catch 200 and drives the needle valve 61 rearwardly through the spray gun body 50. This motion translates the needle nose tip 204 to withdraw back from the needle nose valve seat 184 opening the content evacuation passageway 108 as shown in FIGS. 12-13. When the trigger 58 is released, the compression spring 206 pushes against the catch 200 and drives the needle nose tip 204 back into a fully seated position within the needle nose valve seat 184 closing off the content evacuation passageway 108 as shown in FIGS. 10-11. Thus, the needle valve 61 may translate from a fully closed position (the default position when the trigger is released) to a fully open position allowing for maximum spray output through the spray outlet (110 174, and/or 196) to any position therebetween allowing the user great flexibility in varying the amount of contents being spray out through the spray outlet under pressure. The variable position of the needle valve, other than a closed position, allows at least a portion of a sprayable texture material 46 pre-loaded into the pressurized cartridge 44 to be sprayed out onto the surface through the selected spray outlet. This feature provides significant control over an aerosol can delivery device.

With reference to FIGS. 11 and 13, the tapering transition of the tip 204 of the needle valve has been found to aid in the improved flow rate and spray pattern for joint compound material. In this exemplary embodiment, as shown in FIGS. 11 and 13, the interior bore of the spray tip adapter 172 has a tapered forward section 184 (needle valve seat section) converging from the outer diameter of the elongated forward section toward an axial center line of the elongated forward section 182 at an angle of fifteen degrees or approximately fifteen degrees, although this is not meant to be limiting, as a range of five to forty-five degrees may be used for example. The tapered forward section 184 appears as a frustoconical or truncated cone profile in FIGS. 11 and 13 transitioning from the elongated forward section 182 to the cylindrical nozzle orifice 180. In this exemplary embodiment, the elongated forward section 182 measures (or approximately measures) 15/100 of an inch in diameter while the nozzle orifice 180 measures (or approximately measures) 6/100 of an inch in diameter. The inwardly tapered section 184 of the spray tip adapter generally complements at least a portion of the taper of the needle valve nose tip 204 to provide a seal when the trigger 58 is released and the needle valve in the closed position (FIG. 11) while the contour of the tapered end of the needle valve provides a preferred flow of the compound through a 6/100 of an inch diameter nozzle orifice 180 leading out of the spray tip adapter 172 when the trigger is squeezed and the needle valve is withdrawn into an open position (FIG. 13).

As shown in FIGS. 11 and 13, the 15/100 of an inch diameter of the spray tip adapter orifice 182 is slightly larger than the 14/100 of an inch diameter of the elongated forward cylindrical section 202 of the needle valve 61 so that contents entering into the junction section 124 may flow all the way forward to approximately the transition shoulder of the tapering section of the seated needle nose tip 204. This close fitting relationship between the outer diameter of the spray needle valve and inner diameter of the spray tip adapter orifice minimizes the void between these two structures to reduce buildup while allowing a certain amount of material to be primed for immediate spraying when the trigger is actuated. This results in a more sensitive trigger 58 since very little squeezing applied to the trigger results in evacuation of the pressurized contents out through the spray nozzle outlet 174 or 196 of the spray tip protector 186. This is assisted by the inverted cartridge orientation since both pressure and gravity assist in keeping the passageway 108 full while the release valve 238 of the cartridge is open. In addition, reducing the length and voids in the passageway 108 from the pressurized cartridge 44 into the main barrel 54 of the spray gun body 50 and out the spray tip adapter 172 helps to develop a texture spray more in line with atomized paint for an improved spray pattern. This is partially assisted by mounting the outlet of the cartridge close to the spray port. The needle nose tip 204 of the needle valve may have one or more tapered sections. For example, as shown in FIGS. 11 and 13, the exemplary tip 204 measures (or approximately measures) 15/100 of an inch in length with a first tapered section 205 measuring about 11/100 of an inch in length. This first tapered section 205 generally complements the taper of the tapered section 184 of the spray tip adapter 172 to provide a useful seal between the needle valve and inner bore of the spray tip adapter when the trigger is released. Extending from the first tapered section 205 is a second, more severe, tapered section 207 with a length of approximately 4/100 of an inch and a rearward taper of approximately 125-135 degrees from the axial centerline of the needle to the transition to the first taper. While the first taper generally functions to provide a useful seal between the needle valve and spray tip bore, the second tapered section is generally selected to provide different spray effects or patterns. It will be appreciated that both a single tapered, flat, faceted, channeled, grooved, or rounded needle tip may also be used as alternative configurations.

The Interchangeable Cartridge:

Referring now to FIGS. 1 and 7-8, 9B, and 10, the cartridge 44 or pressure vessel includes a content receiving chamber 225 with a generally cylindrically shaped side wall 226 and a flat base 228 on one end and a tapering curved shoulder 230 that terminates on the opposing top end with a mounting collar 232. The cartridge mounting collar 232 may be further broken down into a ridged gripping section 234 that transitions to a reduced profile externally threaded post 236. As shown in FIG. 9B, the threaded post is at least partially hollow and includes a male pressure relief valve 238 projecting along a central longitudinal axis of the cartridge 44 and blocking the opening 239 of the cartridge and partially seated within the cartridge mounting collar. Normally the pressure in the cartridge when filled biases the male pressure relief valve in the closed position as shown in FIG. 9B to prevent the contents from escaping prematurely. The pressure relief valve 238 may also be pushed into an open configuration to release the contents of the cartridge through the valve 238 and mounting collar 232 on into the cartridge seat 152 and into the secondary leg 114 of the main barrel 54 of the spray gun body 50. It will be appreciated that, instead of using an electrical pump or external pressurizing source such as a compressor as in the cumbersome conventional devices, the cartridge is preferably pressurized when sold to provide the driving force for the contents through the gun when accessed. In this exemplary embodiment, the cartridge does not include a dip tube normally required in pressure vessels mounted in the upright position as opposed to an upside down position for the present cartridge as described below.

Contents of the Interchangeable Cartridge:

Referring to FIGS. 9B, 10, 12, and 14, for texturing purposes the volume of sprayable contents, generally designed 46, pre-loaded into the content receiving chamber 225 of the cartridge 44 in this exemplary embodiment is a mixture of compressed gas 240 and joint or drywall compound 242, either the joint compound or topping compound variety and known generally in the industry as mud or drywall taping mud. Mud is primarily used for concealing joints between drywall sections (i.e. finishing gypsum panel joints for example) corner bead, trim and fasteners, and smoothing out drywall surfaces and removing blemishes by skim coating. Higher volume machines such as the commercial hoppers discussed above are used for initial construction and large reconstruction projects. The primary focus of this exemplary embodiment, however, is aimed at localized restoration projects such as fixing minor blemishes or damage to walls by patching up holes, bumps, tears, and other minor damage on a smaller scale by using the gun/cartridge assembly 40 to apply to apply a topical or cosmetic layer to a surface such as a wall wherein the natural restoration is desired. One such suitable compound with a suitable viscosity for use with the nozzle of this gun may be purchased from Specialized Building Products (SBP) of Orange, Calif. In general, joint compound is similar to plaster. Both slow-drying and quick-drying compounds are contemplated. There is also a ready-mix lightweight joint compound generally made of water, limestone, expanded perlite, ethylene-vinyl acetate polymer and attapulgit (a kind of crystalloid hydrous magnesium-aluminum silicate mineral also known as palygorskite and one type of fuller's earth) that may be used. One exemplary formulation for the contents 46 of a pressurized cartridge 44 consists of approximately 500-525 grams of texture material, approximately 0.01 to 5 grams of distilled water, approximately 45-55 grams DME (dimethyl ether) propellant, and a nitrogen cap used in conjunction with the DME as propellant in a typical twenty ounce (567 g) cartridge 44.

For purposes of coating a drywall type surface, a cartridge 44 pressurized in the range of 70 to 105 psi has been found to deliver a suitable spray pattern and covering. It will be appreciated that while the most common color for the drywall compound is white or off-white, color additives may be added into or mixed with the cartridge contents to produce a compound that matches a preferred color of the surface to be covered. The compound used herein is also preferably relatively quick drying but this is not a limitation. While one layer may be sufficient for purposes of the cosmetic application, additional layers are contemplated during use. Other compounds that may be used with the gun/cartridge assembly include spackling paste, plaster, and other relatively viscous substances including floor coatings, exterior coatings, and safety grip coatings as several non-limiting examples.

Assembly of the Spray Gun System:

To assemble the spray gun system 40, assuming the individual spray gun 42 and cartridge 44 components have already been assembled, the user may simply grab a pre-loaded cartridge 44, remove a cap if used, invert the cartridge and screw the mounting collar 232 of the cartridge into the complementary threads of the cartridge seat 152 until the pressure relief valve 238 is engaged by the pressure relief cone 170 to open a passage from the cartridge into the spray gun body 50. It will be appreciated that the mounting collar may be indexed or constructed to stop turning once the pressure relief valve 238 is opened. The spray gun assembly 40 is ready for use at this point. An exemplary weight of an assembled spray gun system 40 with 567*g* capacity cartridge is approximately 1.9 pounds with the gun weighing around 0.9 pounds. However, this is not meant to be limiting in any manner as the materials and size of both components may vary as well as the weight of the cartridge contents.

The Spray Gun System in Use (Orange Peel and Knockdown):

While many practical applications are possible, in this exemplary embodiment, the application of a volume of contents 46 (FIG. 14) in the form of a joint compound, known in the industry as mud, will be described. Referring now to FIGS. 1, 9A-9B and 14, in this example it is assumed that the cartridge 44 is filled with the desired substance 46, pressurized, and the pressure relief valve 238 is in the sealed position (FIG. 9B). A joint or surface site 48 to be textured or covered may be generally prepared by scraping away loose paint or sanding off protrusions or rough spots if present to prepare a smooth surface. The user may then select a cartridge 44 filled with the desired material 46, invert the cartridge, and mate the cartridge with the gun barrel 54 by inserting the externally threaded post 236 of mounting collar 232 of the cartridge into the internally threaded region 158 of the ringed seat 156 and twisting the cartridge until tight. Twisting of the cartridge may be facilitated by gripping the ridged section 234 and turning relative to the gun collar to tighten as necessary. With the cartridge and gun assembled together, the pressure relief valve 238 is actuated (opened as in FIGS. 10 and 12) and at least a portion of the volume of contents 46 evacuates the cartridge 44 under pressure and floods into secondary leg 114 of the main barrel 54 of the spray gun body through the cartridge seat 152. The portion of the contents continues through the junction 124 on into the primary leg 112 of the main barrel and generally surrounds the forward elongated section 202 of the needle valve 61 where the contents are inhibited from further evacuation through the contents evacuation passageway due to the seal created between the needle tapering nose tip 204 and the tapering sidewalls of the narrowing primary leg 112 of the main barrel 54 as in FIGS. 10-11.

Figure 14:
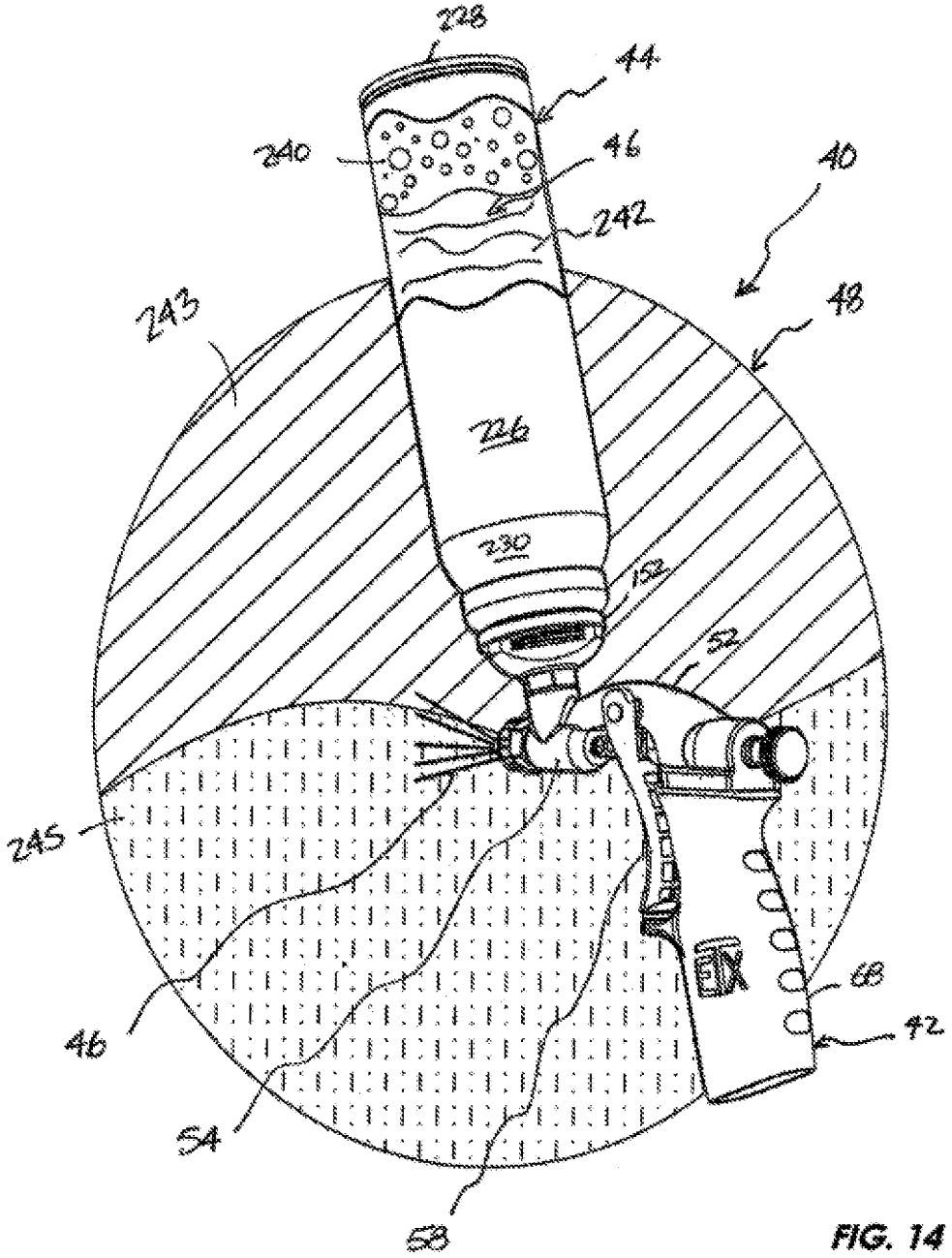
FIG. 14 is a rear perspective view of the spray gun system in use applying a texture to a surface with a partial cutaway of the cartridge.

With the contents loaded into the primary leg 112 of the main barrel 54, the user may simply direct the exit orifice 110, 174, or 196, depending on which component (spray tip adapter 172 or 186 spray tip protector), if any, is attached to the main barrel 54 toward the intended target surface 48 and squeeze the trigger 58 toward the handle 68. Squeezing the trigger 58 causes the tip 204 of the needle valve 61 to translate axially along a length of the main barrel 54 and toward the back end 116 of the barrel removing the needle valve tip 204 from the exit orifice 174 of the spray tip adapter 172 as depicted in FIGS. 12-13. Contents 46 of the cartridge 44 under pressure release through the flow channel 108 around the needle valve 61 and out the exit orifice 174 onto the target surface 48 (FIG. 14). The user continues to squeeze the trigger 58 to allow additional material 48 to spray out of the gun while aiming the spray tip adapter 172 to properly cover the target surface as desired. The user may also vary the squeezing pressure on the trigger to vary the spray output as desired. Alternatively, the adjustment knob 212 may be turned to vary the spray flow. The user maintains a suitable distance from the target surface to provide a desired spray pattern and thickness.

When the user elects to stop spraying the contents 48 of the cartridge 44, the user simply releases pressure on the trigger 58 and the needle valve 61 returns to its seated position (FIGS. 10-11) with the narrowed tip 204 nested back within the outer portion of the spray tip adapter 172 to close off the spray nozzle outlet or exit orifice 174. The opening and closing process may be repeated as desired to complete the surface covering task. A single 532 ml cartridge pressurized to 75 psi has been found to provide a single surface coating layer of up to 80 square feet but different sized cartridges or canisters are contemplated depending on the area to be covered. Once the compound 46 is applied, the resulting spray pattern may either be allowed to dry as is or smoothed or textured using an application tool such as a trowel, scraper, or suitable texturing tool.

If another cartridge 44 is required, the user may release the trigger if squeezed or depressed to seal off the spray nozzle outlet 174 and cease spraying. The user may then twist the cartridge 44 in the opposite direction used when mating the cartridge to the cartridge seat 152 to disengage the cartridge from the ringed seat 156 and dispose of the cartridge or reuse for recycling, if available. Another preloaded or partially full cartridge may be attached to the spray gun 42 for subsequent use. It will be appreciated that the use of the interchangeable cartridge greatly aids in the speed and cleanup of the process. The gun is preferably lightweight and many portions such as the handle may be constructed of a rigid plastic material while the barrel may be cast or stamped metal such as lightweight aluminum or a more durable steel alloy. While the contents of the cartridge may add to the overall weight, one hand use is contemplated and thus the overall device is constructed to be a lightweight product. The handle may be constructed to facilitate left or right hand use.

After each use when the cartridge 44 is not used up, the spray gun assembly 40 may be inverted (upside down relative to FIG. 1) and the trigger 58 depressed for two to three seconds to clear the content evacuation passageway 108 of the texture material since a small quantity of compressed gas will rise to the top of the inverted cartridge and blow through the passageway 108 clearing the passage of texture material. This procedure assists in keeping the spray gun assembly clean and prevents texture from clogging up the passageway 108. In addition, it is contemplated to use a dedicated cleaner cartridge similar in construction to the pressurize cartridge 44. The cleaner cartridge may contain a mixture of alcohol, water, scent, and a lubricant. The cleaner cartridge may be mounted on the spray gun 42 in a manner similar to the pressurized cartridge 44 and the trigger depressed to send the cleaning mixture through the spray gun passageway 108 to provide an improved method of cleaning out the spray gun 42, especially when high viscosity or quick drying contents are used. Ideally, the cleaner cartridge mixture will dissolve and evacuate any residue left over in the passageway 108 after using the spray gun 42 with the pressurized cartridge 44. While both the contents cartridge 44 and the cleaner cartridge are preferably sized for multiple applications, a single application size is also contemplated.

A significant advantage of the spray gun system 40 is the ability to spray both orange peel textures 243 and knockdown textures 245 (FIG. 14) from the same delivery device 42. For example, the user may squeeze the trigger 58 to a first position preferable for spraying out an amount of the volume of contents 48 at a rate conducive to applying an orange peel style texture 243. Alternatively, using the same cartridge, the user may squeeze the trigger to a second position preferable for spraying out an amount of the volume of contents 48 at a rate conducive to applying a knockdown style texture 245. The dual texture mode may be accomplished using the spray tip adapter 172 with or without the spray tip protector 186. Alternatively, the user may add another interchangeable spray tip adapter or spray tip protector to further enhance the ability to apply both knockdown and orange peel textures. Alternative spray tip adapter or spray tip protectors may also include alternative spray outlet configurations that are dedicated to spraying out one or more particular substances or patterns.

Exemplary Materials:

The spray gun 42 is generally constructed of a lightweight metal such as aluminum or constructed of plastic. The cartridge 44 may be formed of a lightweight aluminum as well. The spray tip adapter 172 and spray tip protector 176 may be formed of a brass or other suitable metal or material such as plastic or other suitable metal. The grip portion of the gun handle 68 may be enhanced with a rubber material or coating as may be the forward facing surface of the trigger 56. While a screw type coupling is described for mating the cartridge to the gun, other suitable fasteners that provide sufficient strength to lock the pressure vessel to the barrel and provide an airtight seal including bayonet style clips are contemplated. Lifting and shaking the container will provide an approximate gauge of the remaining volume. In addition, in this exemplary embodiment, the cartridge incorporates a male pressure relief valve 238 while the cartridge seat 152 incorporates a female pressure relief cone 170. These two components are interchangeable and other pressure relief valve and release systems are within the skill of one of ordinary skill in the art.

Other Uses of the Spray Gun System:

While the embodiments described herein have primarily been discussed relative to the application of drywall texture, other pressurized materials are contemplated including oils, soaps, window cleaner, household and industrial cleaners, brake cleaner, carburetor cleaner, sanitizing products, starter fluid, spray paint, thinner, overcoating, urethanes, lacquers, spray adhesive, pesticides (including herbicides, insecticides, insect growth regulators, nematicides, termiticides, molluscicides, piscicides, avicides, rodenticides, predacides, bactericides, insect repellents, animal repellents, antimicrobials, fungicides, disinfectants, and sanitizers), keyboard/computer cleaner, non-skid coating, wood sealer, mold remediation substances, concrete sealer, concrete stain, concrete overlay, wood stain, deicer, and herbicide to name just a few. In general, any sprayable substance may be preloaded into the cartridge and used with the spray gun system 40. Different viscosities may be accommodated as well. Each application may use a generic or specialized spray tip.

Figure 16A:
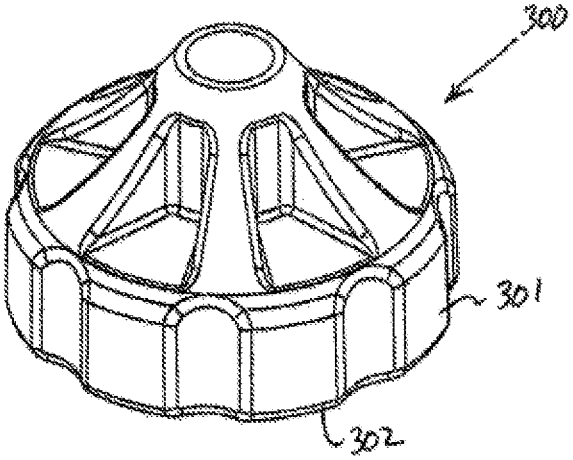
FIGS. 16A-C depict upper perspective (FIG. 16A), side (FIG. 16B), and side cross-sectional views (FIG. 16C) taken along lines A-A of FIG. 16B of an exemplary knockdown spray tip for use with the spray gun system in accordance with the principles of the present invention.
Figure 16B:
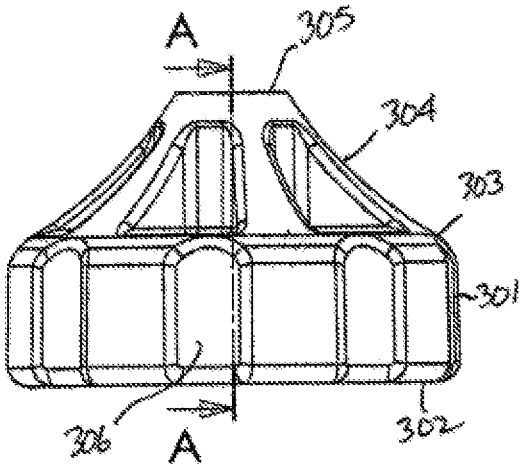
Figure 16C:
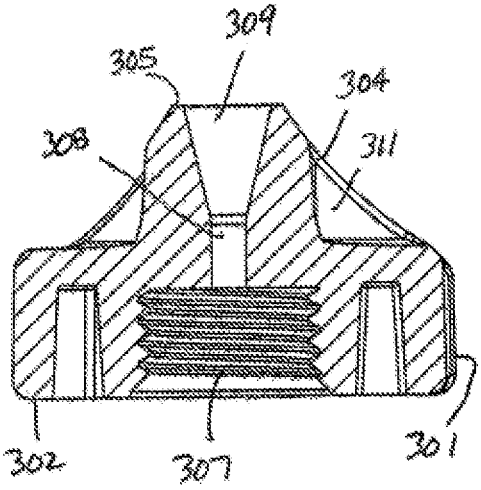

Interchangeable Tips:

As an alternative, the spray tip protector 186 may be removed and replaced with an alternative spray tip as discussed below in relation to FIGS. 16A-21B. Thus, by using alternative spray tip protectors 186 or spray tips on the spray tip adapter 172, the user may further accommodate a variety of spray patterns and alter the spray pattern in accordance with the substance or contents being sprayed under pressure from the cartridge 44 onto the desired surface 48 (FIG. 14). For example, referring now to FIGS. 16A-21B, a variety of interchangeable spray tips are depicted, each one having a preferred, but non-limiting, application. More specifically, referring to FIGS. 16A-C, a knockdown spray tip, generally designated 300 is illustrated. Referring to FIGS. 16A-16B, the knockdown spray tip 300 generally includes a cylindrical base section 301 with a flat bottom 302 and an opposing upper edge 303 that transitions into a conical nozzle section 304 terminating in a flat nose 305. The outer surface of the base section includes one or more dimples 306 to facilitate grasping and turning. As shown in the cross section of FIG. 16C, the internal spray path projects through a threaded section 307 for engaging the forward external threaded section 178 of the spray tip adapter 172 and into a cylindrical throat section 308 before expanding into an expanding conical spray outlet 309 similar to a contact lens shape that terminates in the flat nose 305 of the spray tip. The throat 308 and spray outlet 309 form the spray profile of this tip 300. Lightening or mold favorable recesses 311 may be incorporated into the outer surface of the knockdown spray tip 300 as well.

Figure 17:
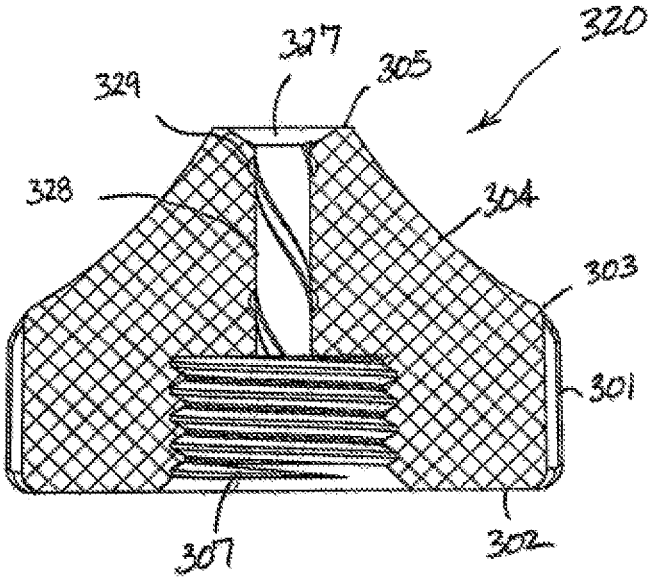
FIG. 17 depicts a side cross-sectional view of another exemplary knockdown spray tip for use with the spray gun system in accordance with the principles of the present invention.

Referring now to FIG. 17, a knockdown spray tip, generally designated 320 is illustrated. The exterior of this spray tip 320 is the same as in FIGS. 16A-B and like numbered components are like numbered. The difference is the throat section 328 of the knockdown spray tip 320 that is enlarged in diameter relative to the throat section 308 of the previous knockdown spray tip 300 (FIG. 16C) and terminates in a hemispherical dimple shaped spray outlet 327. This orifice 328 of spray tip 320 has been found to be one preferred embodiment for knockdown texture while the expanding conical orifice 309 of the prior spray tip 300 has also been found to be preferred for knockdown texture applications. However, this is not meant to be limiting and other orifice diameters and profiles may be used as explained below. The throat preferably includes one or more spiral grooves 329. This rifling may be used to enhance or alter the fluid flow characteristics of the contents passing through the spray tip. A smooth bore or bore with partial rifling may also be used however.

Figure 18A:
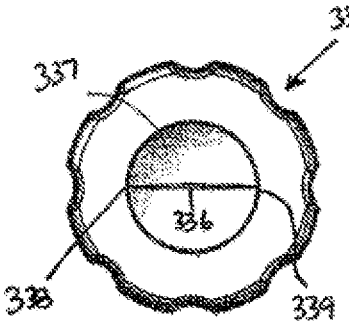
FIGS. 18A-C depict a top view, a side view, and a cross sectional spray head profile taken from lines A-A of FIG. 18B of a third alternative spray tip that may be used with the spray gun apparatus in accordance with the principles of the present invention.
Figure 18B:
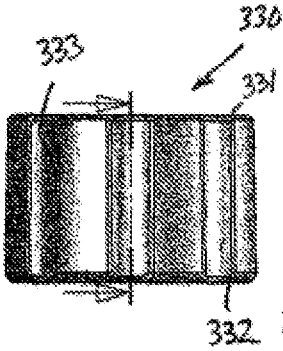
Figure 18C:
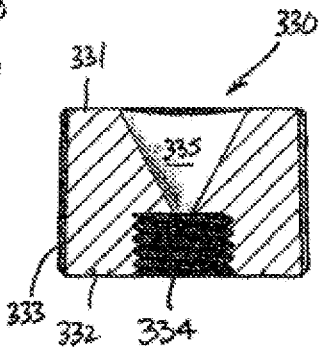

Referring now to FIGS. 18A-C, a spray tip generally designated 330 is illustrated. This spray tip 330 is generally ring shaped with opposing flat top and bottom surfaces, 331 and 332, respectively. The outer surface of the cylindrical sidewall 333 is knurled to provide better purchase while screwing the spray tip on and off the spray tip adapter 172.

As shown in FIG. 18C, the interior of the spray tip 330 includes a threaded interior region 334 for engaging the forward external threaded section 178 of the spray tip adapter 172. At the upper end of the threaded section, the throat 335 of the spray outlet passage is narrowed in width and then flares outwardly to provide a conical profile. A narrow horizontal slit 336 penetrates a hemispherical dimple 337 as viewed in FIG. 18A to provide the spray outlet and is widest at the horizontal centerpoint and converges at the opposing left and rights ends 338 and 339, respectively.

Figure 19A:
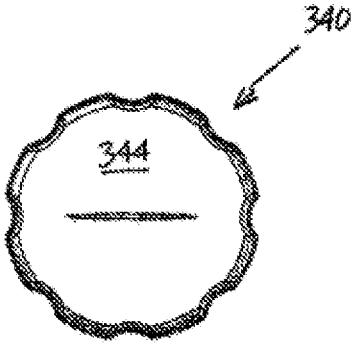
FIGS. 19A-B depict a respective top view and cross sectional spray head profile of a fourth alternative spray tip that may be used with the spray gun apparatus in accordance with the principles of the present invention.
Figure 19B:
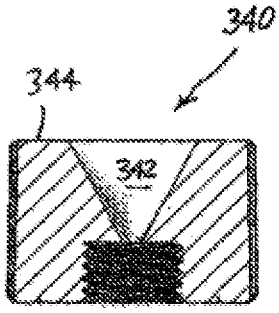

Referring now to FIGS. 19A-B, a spray tip generally designated 340 is illustrated. This spray tip 340 is generally constructed in the same manner as spray tip 330 except that the throat section 342 terminates in an outer flush surface 344 instead of a dimple.

Figure 20A:
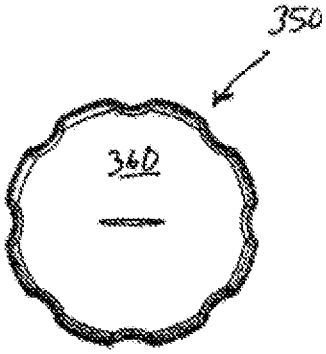
FIGS. 20A-B depict a top view and a cross sectional spray head profile of a fifth alternative spray tip that may be used with the spray gun apparatus in accordance with the principles of the present invention.
Figure 20B:
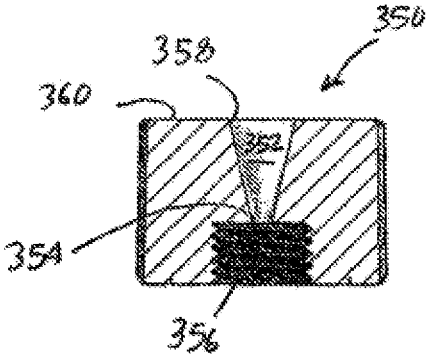

Referring now to FIGS. 20A-B, spray tip generally designated 350 is illustrated. This spray tip 350 is constructed similarly to the spray tip 340 except that the throat section 352 reduced in diameter compared to the throat 342 of tip 330 at both the inner end 354 adjacent the interior threaded region 356 and the outer end 358 and terminates in an outer flush surface 360 as well instead of a dimple.

Figure 21A:
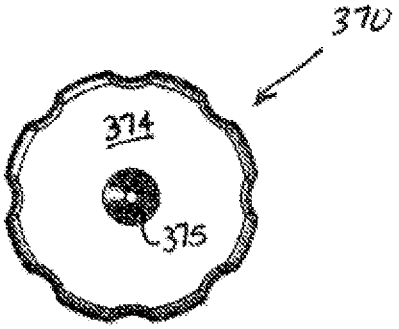
FIGS. 21A-B depict a top view and a cross sectional spray head profile of a sixth alternative spray tip that may be used with the spray gun apparatus in accordance with the principles of the present invention.
Figure 21B:
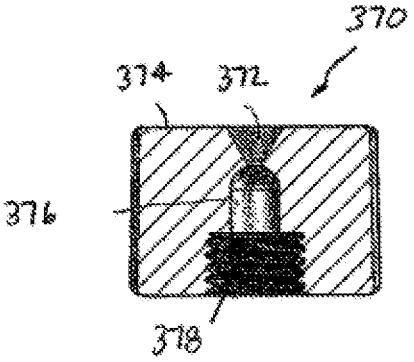

Referring now to FIGS. 21A-B, a spray tip generally designated 370 is illustrated. This spray tip 370 is constructed similarly to the spray tip 350 except that the throat section 372 is a narrower shorter cone in profile compared to the throat section 352 of spray tip 350. The throat section also terminates in an outer flush surface 374 as with the spray tip 350 to provide the conical spray outlet 375. However, a pre-outlet loading chamber 376 is disposed between the threaded interior region 378 and the outwardly flaring throat section 372. The pre-outlet loading chamber is generally round nosed bullet shape in cross section as shown in FIG. 21B and is used for altering the flow rate and characteristics to create alternative spray effects and fluid flow controls.

Figure 22A:
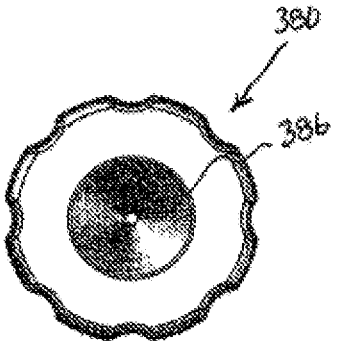
FIGS. 22A-B depict a top view and a cross sectional spray head profile of a seventh alternative spray tip that may be used with the spray gun apparatus in accordance with the principles of the present invention.
Figure 22B:
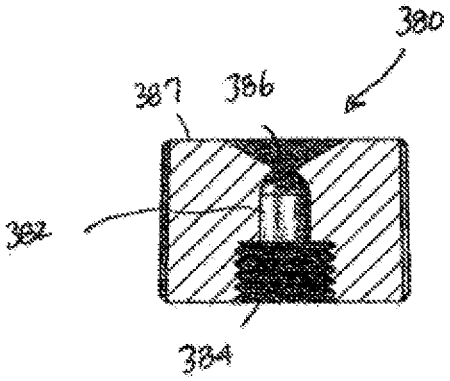

Referring now to FIGS. 22A-B, a spray tip generally designated 380 is illustrated. This spray tip 380 is constructed along the lines of spray tip 370 except that the pre-outlet loading chamber 382 is interposed between the threaded section 384 and a widened throat section 386 compared to the throat 372 of spray tip 370. The throat also terminates in a flat outermost surface 387 similar to the spray tip outlet of spray tip 370. It will be appreciated that the outer side surface construction of spray tips 340, 350, 370, and 380 may be the same as that shown in FIG. 18B or more conical as in FIG. 16B or 17.

From the foregoing, it will be appreciated that the various spray tips may interchange their features to provide new spray profiles including swapping or changing the throat diameters and shapes, the use or non-use of a pre-outlet loading chamber, providing the outlet opening within a flat or dimpled surface, varying the size and shape of the dimple, varying the size and shape of the slit, and using multiple openings or slits. Slits may converge, diverge, provide a combination of contours or be parallel.

Figure 23:
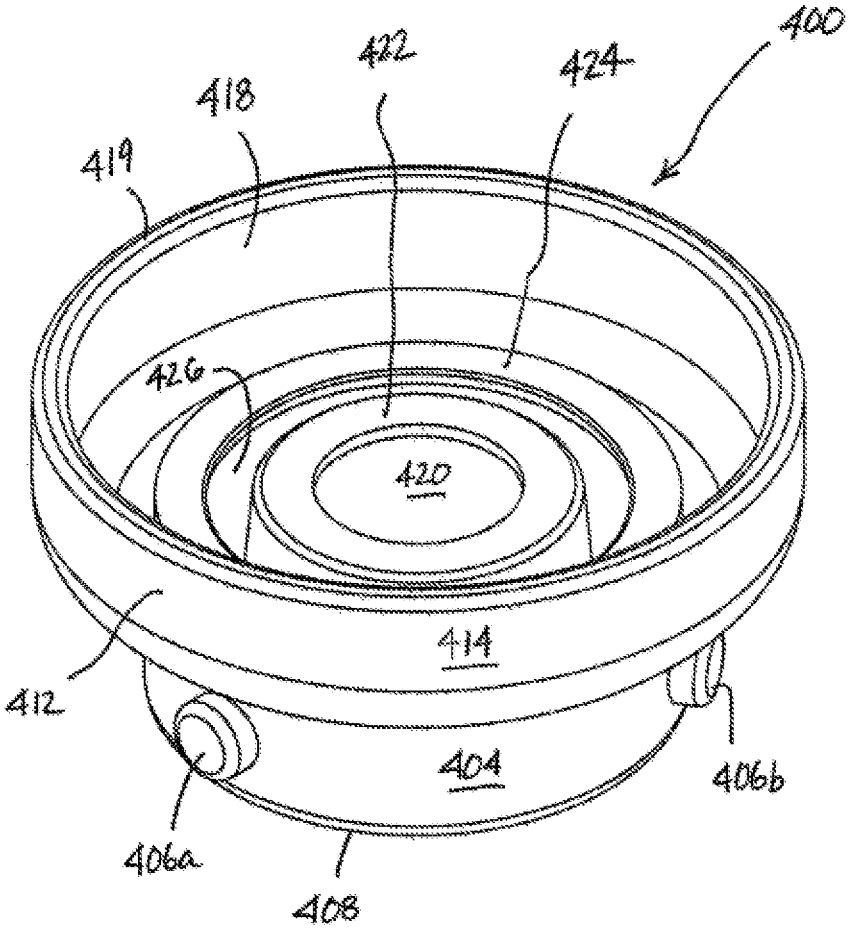
FIG. 23 is an upper perspective view of an alternative mounting collar for mounting the pressurized cartridge to the spray gun body.
Figure 24A:
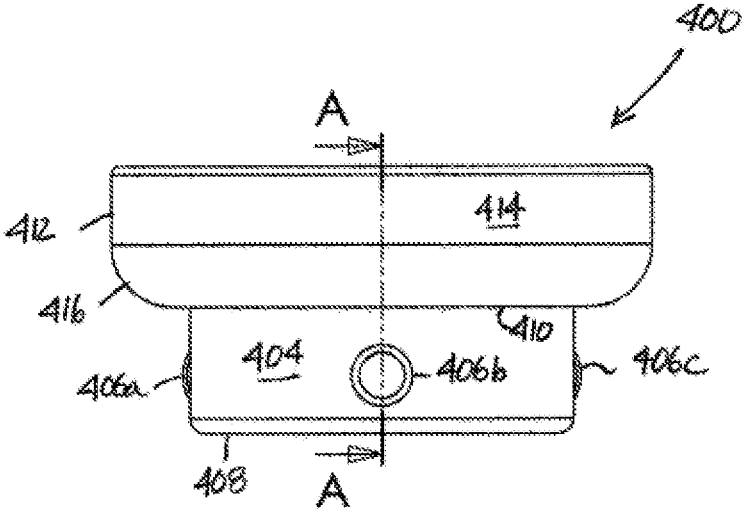
FIG. 24A is a side view of the alternative mounting collar of FIG. 23.
Figure 24B:
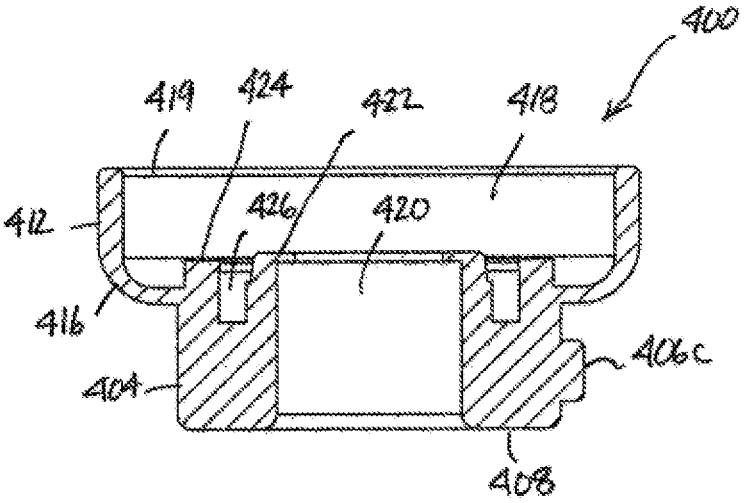
FIG. 24B is cross sectional view taken along lines A-A of FIG. 24A.

Alternative Cartridge Mounting System:

As an alternative to the cartridge seat 152 and mounting collar 232 engagement discussed above, a quick engagement version may be used. Referring now to FIGS. 23-27, an alternative quick engagement mounting collar, generally designated 400 (FIGS. 23-24B and 27), for engaging an alternative cartridge seat, generally designated 402 (FIGS. 25-27), will now be described. With reference to FIGS. 23-24B, the mounting collar 400 includes a cartridge seat engagement section 404 in the general form of a cylindrical sidewall with a set of three bosses 406*a-c* extending outwardly from the sidewall. Each boss has flat outer surface with a rounded shoulder transitioning to a round perimeter. The bottom surface 408 of the sidewall opposes a top surface 410 that meets an enlarged diameter cartridge receiving section 412. In this exemplary embodiment, the bosses do not extend outwardly beyond the sidewall 414 of the cartridge receiving section 412. The cartridge receiving section has a rounded shoulder 416 providing a transition from the cartridge seat engagement section 404 and the outermost sidewall 414 of the cartridge receiving section.

Figure 27:
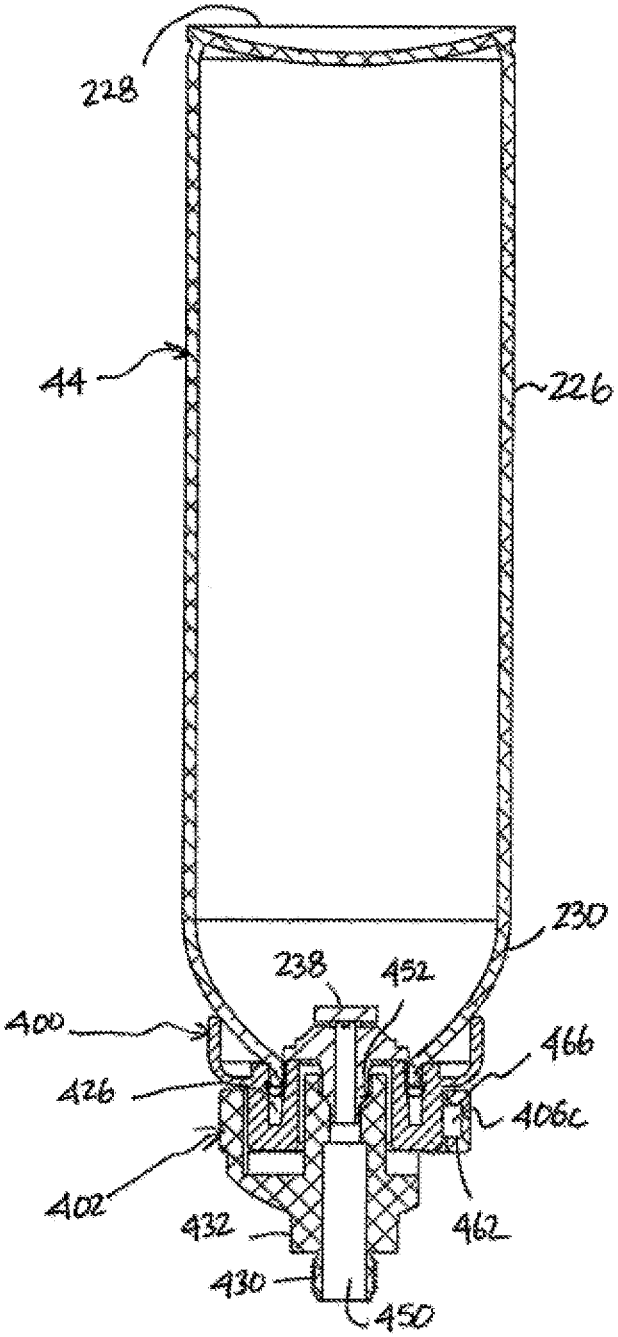
FIG. 27 is a cross sectional view of a cartridge assembly including the mounting collar of FIGS. 23-24B releasably engaged with the cartridge seat of FIGS. 25-26D and the pressure relief valve in an open configuration.

With continued reference to FIGS. 23-24B, the cartridge receiving section 412 including a hollow interior 418 defined by the circumferential sidewall 414 with an upper rim 419 that provides a seat for engaging the rounded shoulder 230 of the cartridge 44 and receiving the pressure relief valve 238. The bottom interior surface of the hollow interior includes a central throughbore 420 ringed by an inner plateau 422 and a concentric, outwardly spaced apart plateau 424. The outer plateau 424 is recessed downwardly relative to the inner plateau 422. A gap 426 between the plateau rings 422 and 424 receives a rim portion of the cartridge 44 to engage and lock the mounting collar 400 and cartridge together as shown in FIG. 27. With the mounting collar secured to the cartridge 44, the pressure relief valve 238 seated against the outer plateau 424 with the lower portion of relief valve inserted into the throughbore 420 as in FIG. 27 for engagement with the cartridge seat 402 discussed below.

Figure 25:
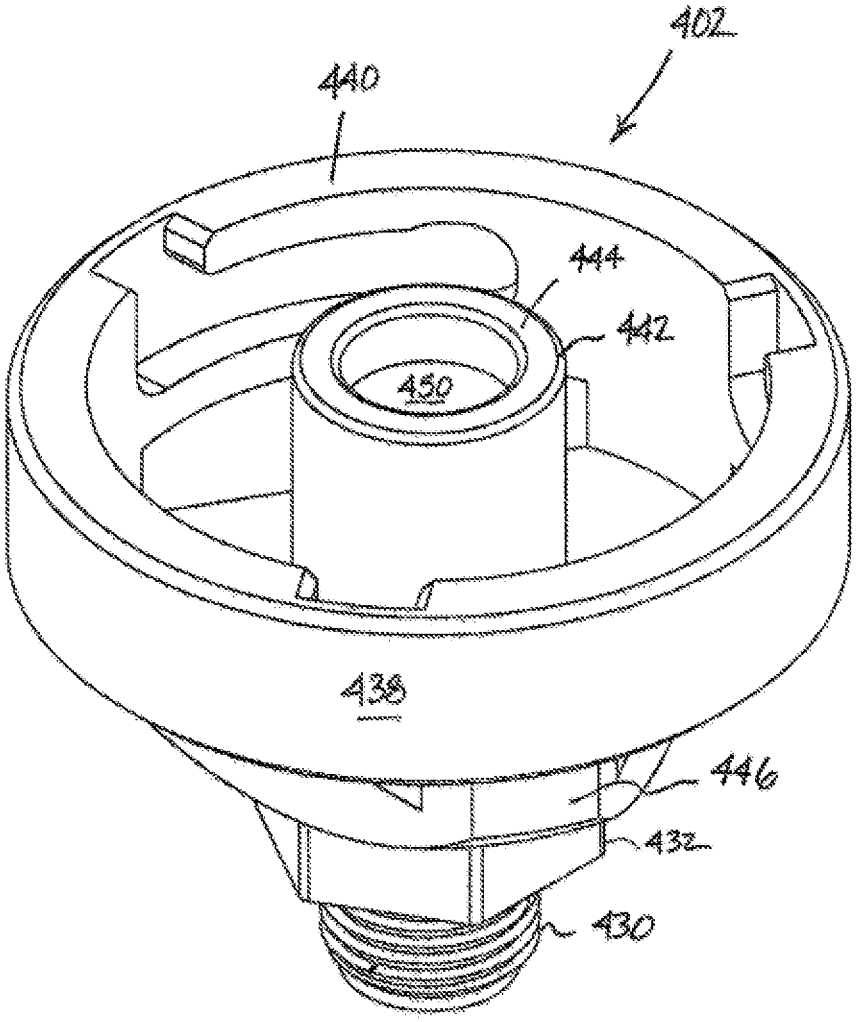
FIG. 25 is an upper perspective view of an alternative cartridge seat for use with the mounting collar of FIG. 23.

Referring now to FIGS. 25-27, the cartridge seat 402 includes a lowermost threaded post 430 with external threads for releasably engaging the internal threads of the cartridge seat coupling section 148 (FIGS. 9A and 10) of the main barrel section 54 of the spray gun body 50 as with the earlier embodiments. Above the threaded post is a hexagonal section 432, slightly larger in profile than the threaded post 430, providing a face for engaging a tool such as a crescent wrench for assisting the user in tightening the cartridge seat 402 to the spray gun body 50. Above the hex nut section 432 is an outwardly and upwardly curved support section 434 that supports the mounting collar seat section 436 defined by a cylindrical sidewall 438 and terminating in an upper rim 440 of the cartridge seat 402. The support section 434 is an open frame structure of multiple spaced support ribs supporting the mounting collar seat section and surrounding a central pressure relief valve engaging post 442 with a top surface 444 extending slightly above the upper rim 440 of the mounting collar seat section 436. Three support ribs are used in this exemplary embodiment with a window between each pair of adjacent ribs with exemplary rib 446 and window 448 indicated in FIG. 26A.

With continued reference to FIGS. 25-27, the valve engaging post 442 includes a throughbore 450 for channeling contents 46 (FIG. 10) from the interior of the cartridge 44 as passed through the open pressure relief valve 238 into the secondary leg 114 of the main barrel 54 of the spray gun body 50. As shown in FIG. 26B, the interior of the throughbore 450 includes a stepped uppermost section 452 with an inner bevel for engaging the lower section of the pressure relief valve to push the valve open when the cartridge is releasably engaged with the spray gun 42 as shown in FIG. 27. It will be appreciated that the opening of the pressure relief valve is preferably a narrow window, slot, aperture, fenestration, or channel or combinations or multiples thereof when the cartridge is engaged with the spray gun body. However, the stepped uppermost section 452 or the valve may be modified to allow greater or lesser flow through the valve and throughbore 450. For all embodiments, the pressurization of the cartridge, the mixture of the contents, and the shape and length of the passageway 108 including the spray profile also impacts the output or spray pattern of the spray gun system 40.

Figure 26A:
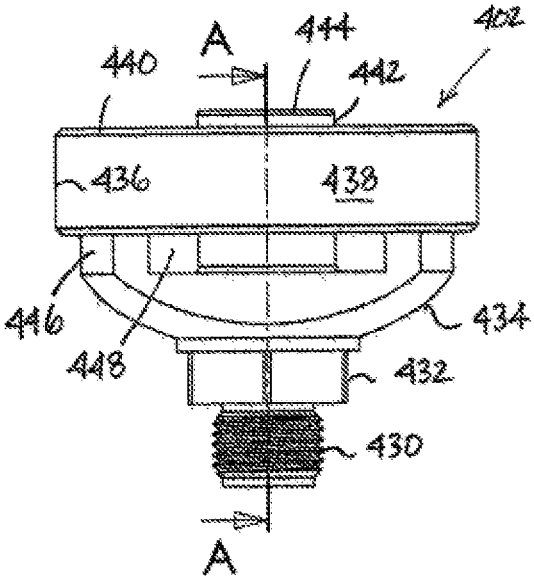
FIG. 26A is a side view, in reduced scale, of the cartridge seat of FIG. 25.
Figure 26B:
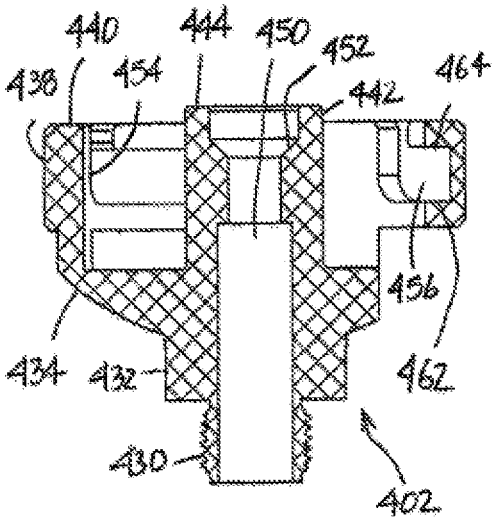
FIG. 26B is a cross sectional view taken along lines A-A of FIG. 26A.
Figure 26C:
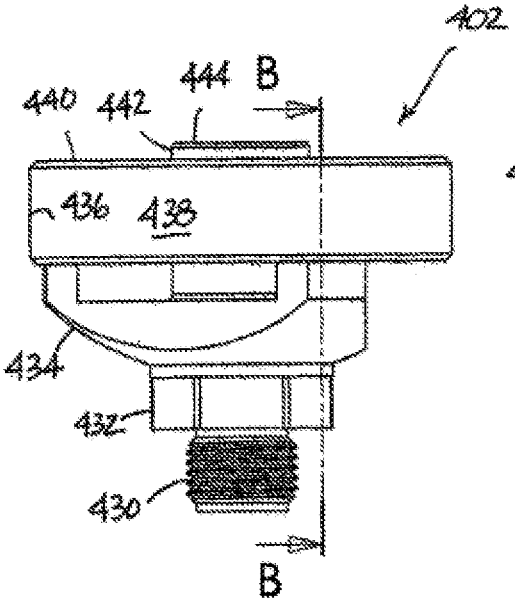
FIG. 26C is the same view as in FIG. 26A with the cartridge seat partially rotated around its central vertical axis.
Figure 26D:
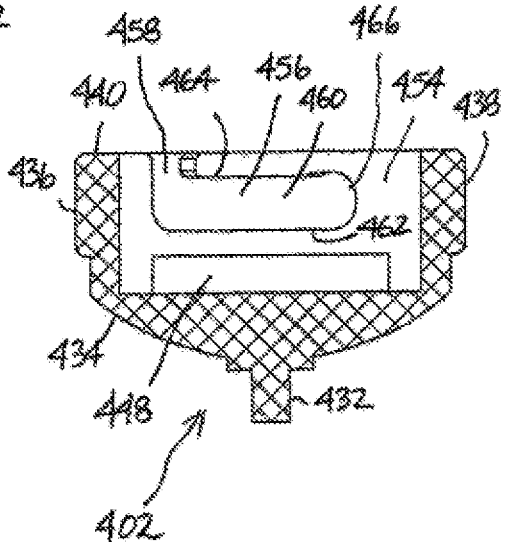
FIG. 26D is a cross sectional view taken along lines B-B of FIG. 26C.

Referring now to FIGS. 26B, 26D, and 27, the interior surface 454 includes a set of three primarily circumferentially projecting slots 456 for slidably engaging the three corresponding bosses 406*a-c* of the mounting collar 400. For ease of description, a single slot 456 is shown in FIGS. 26B and 26D with the understanding that all three slots are identical in construction. The boss receiving slot 456 includes an axially projecting section 458 that transitions into a circumferential track or channel 460 with a lower edge 462 and an upper edge 464 and an end surface 466. The slot 460 is recessed below the upper rim 440 of the mounting collar seat section 436.

Referring now to FIG. 27, it will be appreciated that this mounting collar 400 may be secured to cartridge body of the cartridge 44 and the pressure relief valve 238 described above. This assembly is typically provided to the end user as with prior embodiments described above. Likewise, the threaded post 430 of the cartridge seat 402 may be threadably coupled to the threaded port 148 of the spray gun body 50 and then tightened using a tool engaging the hex section 432. When, the user is ready to couple the cartridge 44 to the spray gun 42, each boss 406*a-c* is aligned with a respective axial entry section 458 and the cartridge and spray gun are pushed together to drive the bosses toward the inner surface 462 of their respective slots 456. Then, with a simply twisting motion, the bosses are rotated through the circumferential portions 456 of their respective slots until engaging the end surface 466 thus releasably capturing the bosses within their respective slots 456. At this point, the cartridge is releasably secured to the spray gun by engaging the mounting collar 400 with the cartridge seat 402 and the pressure relief valve 238 is open. The spray gun system 40 is ready to use with the user having already attached a selected spray tip or adding a spray tip spray port or spray tip adapter.

It will be appreciated that the collar 400 and seat 402 assembly is self-centering making the engagement between the seat and collar easier to align. The rounded perimeters of the bosses 406*a-c* facilitate alignment with and entry into the axial entry sections 458 of the releasable retention slots 456. Although not meant to be limiting, a one-quarter to sixty degree turn has been found sufficient to releasably engage the seat and collar and open the pressure relief valve 238 of the cartridge 44 while retaining the cartridge to the spray gun body 50 in use. Likewise, when disengaging the cartridge from the spray gun, the opposite twisting and retrieval motion is used. This construction saves time over a threaded engagement construction while still retaining the cartridge to the spray gun in a satisfactory manner. The quicker release also inhibits or significantly reduces blowback from the pressurized cartridge compared to a threaded engagement resulting is less residue exiting the cartridge and less mess.

Referring now to FIGS. 28A-35B, wherein many of the like components are like numbered, another alternative exemplary spray tip in the form of a variable spray tip, generally designated 500, may be incorporated into the spray gun system 40 by attaching the variable spray tip 500 to the spray gun apparatus 42 by threading an adapter mounting section 502 to the complementary threaded post 178 (FIG. 11) on the spray tip adapter 172. The variable spray tip may be used to provide a wider variety of spray profiles along discrete points or along a continuous spectrum from one extreme position to another from a single spray tip. As shown in FIGS. 28A-F, in addition to the mounting section 502, the variable spray tip 500 further includes a ring washer or gasket 504, a spray profile control element 506, and an adjusting element 508.

Figure 28A:
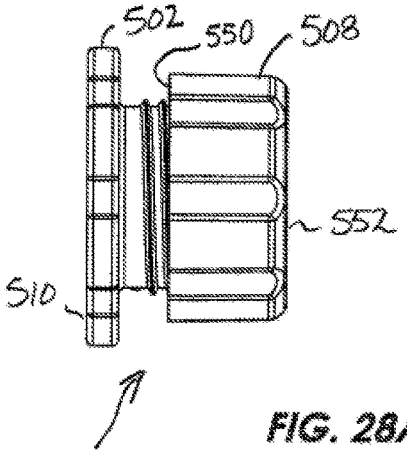
FIG. 28A is left side view of an assembled exemplary alternative variable spray tip in a finer spray configuration that may be used with the spray gun system of FIG. 1.
Figure 28B:
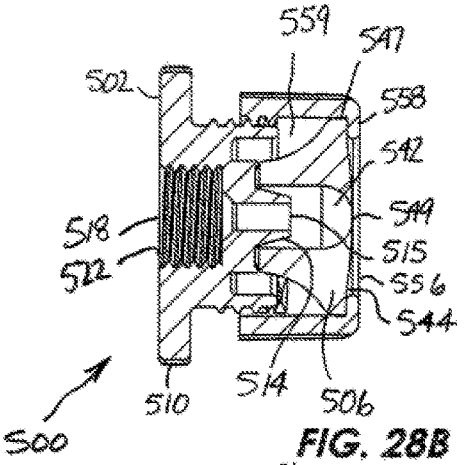
FIG. 28B is a cross-sectional view of the variable spray tip of FIG. 28A.
Figure 28C:
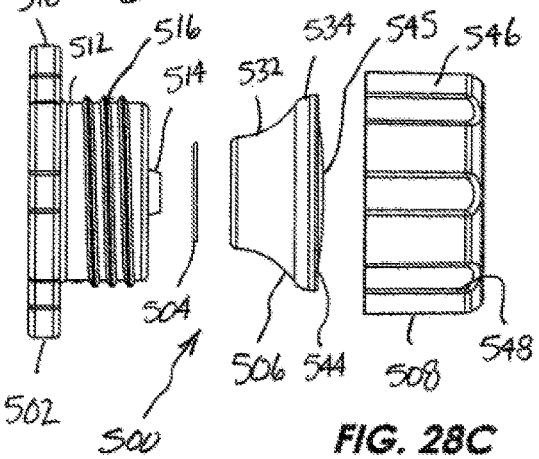
FIG. 28C is an exploded view of the variable spray tip of FIG. 28A in a finer spray configuration.
Figure 28D:
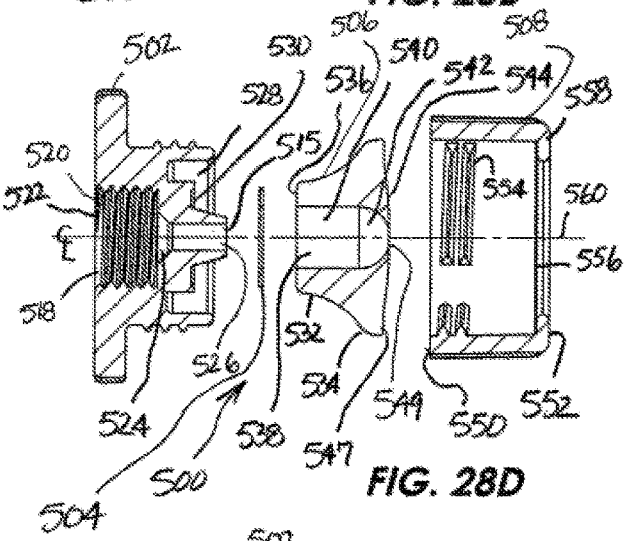
FIG. 28D is a cross-sectional view of the exploded view variable spray tip of FIG. 28C.
Figure 28E:
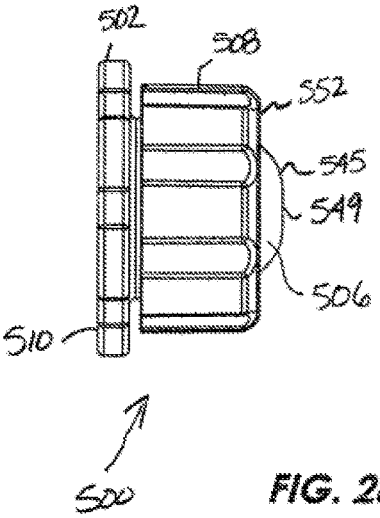
FIG. 28E is a similar view to FIG. 28A with the variable spray tip in a coarser spray configuration.
Figure 28F:
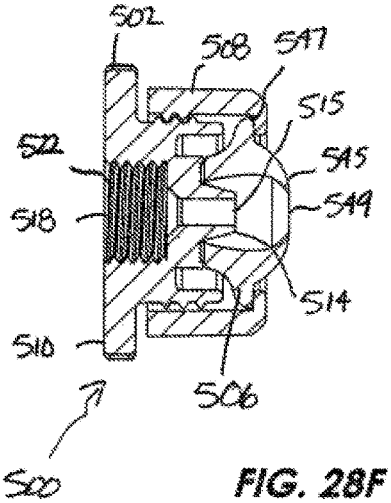
FIG. 28F is a similar view to FIG. 28B with the variable spray tip in a coarser spray configuration.
Figure 29:
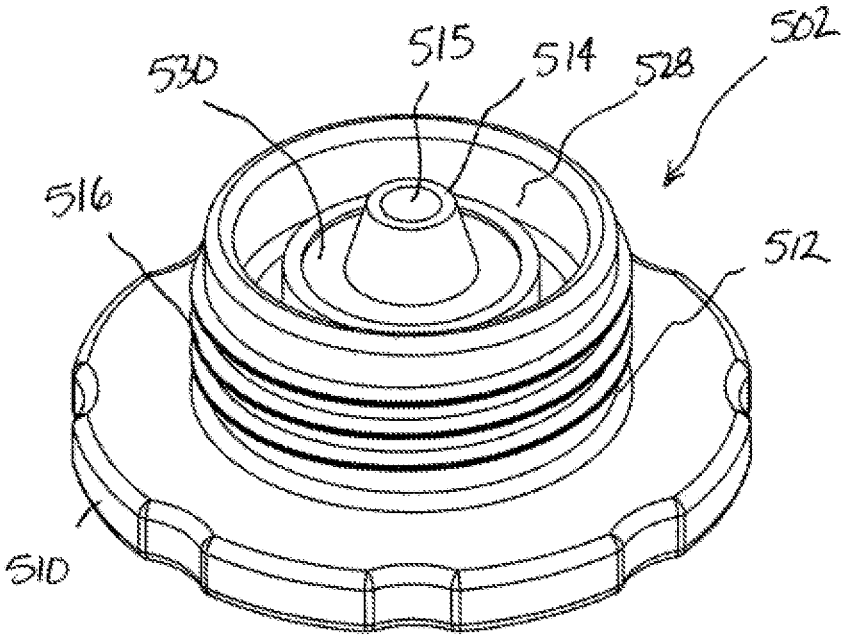
FIG. 29 is an upper perspective view of an exemplary adapter mounting section of the variable spray tip of FIGS. 28A-F.
Figure 30:
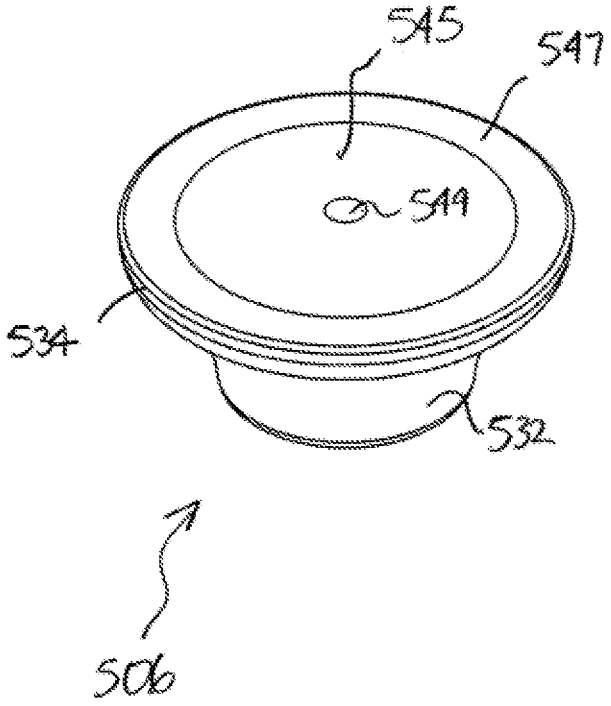
FIG. 30 is an upper perspective view of an exemplary spray profile control element of the variable spray tip of FIGS. 28A-F.
Figure 31:
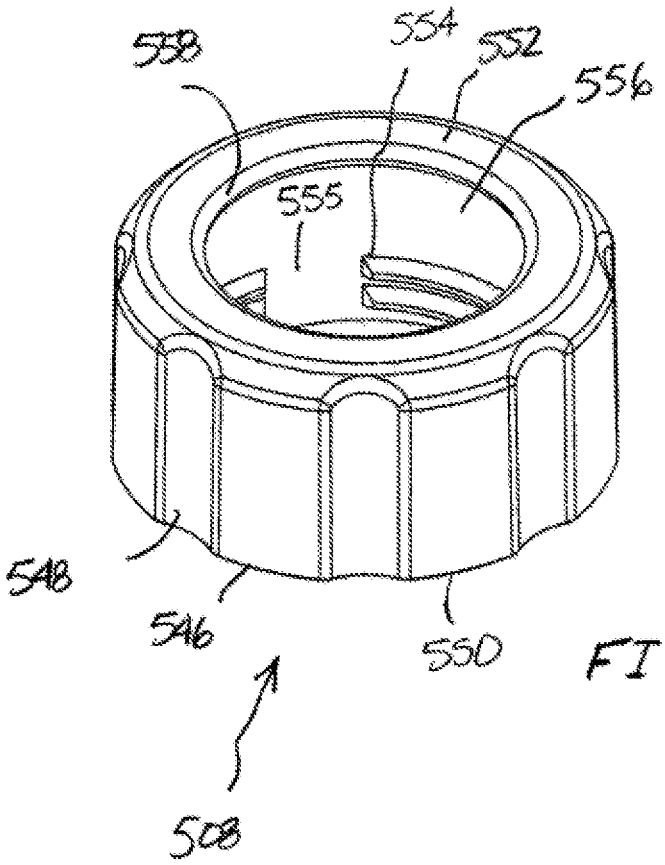
FIG. 31 is an upper perspective view of an adjustment element of the variable spray tip of FIGS. 28A-F.

With continued reference to FIGS. 28A-F and 29, the adapter mounting section 502 includes an enlarged flange 510 that transitions to a reduced profile post 512 terminating in a flow directing tip 514 with a central opening 515 (FIGS. 28B, 28D, 29). The reduced profile post 512 includes external threads 514 for mating with complementary threads of the adjusting element 508 as further explained below. As shown in the cross sectional view of FIG. 28D, the mounting section 502 includes a throughbore 518 with an enlarged inner section 520 with a circumferential set of threads 522 for releasably engaging the complementary external threading on the threaded post 178 (FIG. 11). Downstream from the enlarged inner section 520, the throughbore tapers inwardly forming a shoulder region 524 that in turn transitions to a reduced cylindrical profile flow chamber 526 that extends into and through the flow directing tip 514. Disposed around the flow directing tip 514 is a circular recess 528 with an inwardly disposed circular base 530 for receipt of the ring gasket 504 and a portion of the spray profile control element 506. The adapter mounting section may be constructed of a relatively rigid plastic or metallic material.

As shown in FIGS. 28B-28D, 28F, and 30, the spray profile control element 506 includes a substantially cylindrical base 532 and an enlarged flange 534 flaring outwardly from the cylindrical base. The inner end 536 of the spray profile control element base 532 is constructed to sandwich the ring gasket 504 against the base 530 of the adapter mounting section 502. The interior of the spray profile control element 506 as shown in FIG. 28D includes a profile throughbore 538 with a first cylindrical section 540 having an opening greater in diameter than the outer diameter of the flow directing tip 514 of the adapter mounting section 502. The outermost section 542 of the profile throughbore is rounded with both sections 540 and 542 resembling a round nose bullet shape when viewed in cross-section as in FIGS. 28B, 28D. The outer facing surface 544 of the spray profile control element bulges slightly outwardly near the middle 545 and gently sweeps inwardly and then outwardly to the outermost extent or wings 547. A central spray opening 549 appears in the middle of the outwardly bulging section 544. In this exemplary embodiment, the central spray opening 549 is a circular. However, other suitable shapes such as slits, slots, oblong apertures, racetrack shaped apertures, and polygonally shaped apertures will occur to one of ordinary skill in the art.

Referring now to FIGS. 28A-B, 28E-F, and 31, the adjustment element 508 includes is a circular, substantially hollow collar 546 with a grooved outer sidewall 548 to facilitate turning of the adjustment element. Other suitable external surfaces to facilitate gripping the adjustment element including dimples, depressions, ridges, projections, bosses, knobs, knurled, tacky or slip resistant surfaces may be employed as well. The inner end 550 and outer end 552 of the adjustment element are parallel to one another as shown in FIG. 28A, although the outer edges of the outer end are rounded slightly. The interior of the spray adjustment element is substantially hollow with the interior perimeter surface including a set of internal threads 554 to mate with the external threads 516 of the adapter mounting section 502. The outer end 552 includes a circular opening 556 that spans a majority of the diameter of the collar 546. The perimeter 558 of the circular opening defines an inwardly projecting flange to capture or retain the outer circular edges or wings 547 and sandwich or capture the spray profile control element 506 to the adapter mounting section 502 when assembled. It will be appreciated that the adjustment element 508 is prevented from travel to the left as viewed in FIG. 28A by the enlarged flange 510 of the adapter mounting section 502. In some instances, the adjustment section may be removable completely from the adapter mounting section. In other instances, a set of one or more stops (not shown) may be used to limit the inner and outer travel of the spray adjustment element 508 relative to the adapter mounting section 502.

Overall, the adapter mounting section 502, ring gasket 504, and spray profile control element 506 are symmetrical about an axis passing through a laterally projecting centerline 560 as shown in FIG. 28D. The adjustment element 508 is symmetrical as well except for a difference in the internal threading gaps 555 (FIG. 31) that may be used as stops. Both the adapter mounting section 502 and spray adjustment element 508 may be constructed of a relatively rigid plastic or metallic material. The ring gasket may be constructed of a suitable compressible material to assist in preventing a volume of sprayable material or contents 46 (FIG. 33) from leaking out the variable spray tip and instead maintain the volume of sprayable contents within the preferred flow path. The preferred flow path through the variable spray tip 500 including the path from the orifice 180 (FIG. 35B) of the spray tip adapter 172 entering the throughbore 518 of the adapter mounting section 502 of the variable spray tip 500 and continuing on through opening 515 of the flow directing tip 514 into the spray profile control element 506 and finally exiting through the spray opening 249. The spray profile control element is preferably constructed of an elastic, resilient material, such as silicone, rubber, sponge, or gel allowing for deformation induced by the tightening spray adjustment element and a return its original shape or substantially original shape when the spray adjustment element is loosened.

With reference to FIGS. 28A-F, to assemble the variable spray tip 500, the user may slip the ring gasket 504 over the flow directing tip 514 of the adapter mounting section 502 and against the base 532 of the circular recess 530 surrounding the flow directing tip 514. Next, the spray profile control element 506 is also slipped over the flow directing tip 514 and into the circular recess 530 to abut the ring gasket. The adjustment element 508 may then be slipped over the spray profile control element to engage the interior threads 554 with the external threads 516 of the adapter mounting section and threaded together. At this point, the assembled variable spray tip 500 would resemble the configurations shown in FIGS. 28A-B.

Figure 32:
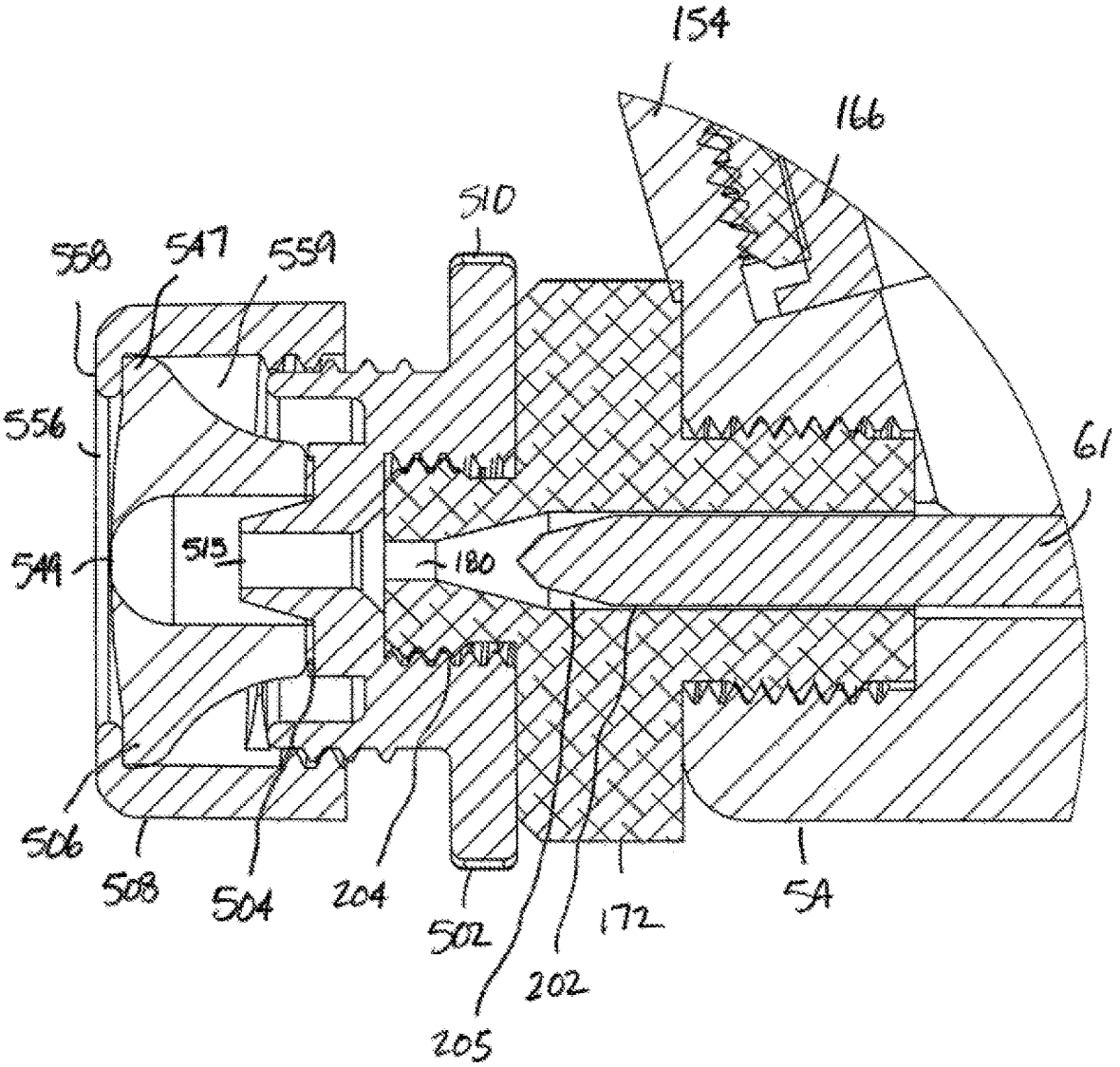
FIG. 32 is a cross-sectional close up view of the variable spray tip of FIGS. 28A-F mounted on the spray gun apparatus of the spray gun system of FIG. 1.
Figure 34A:
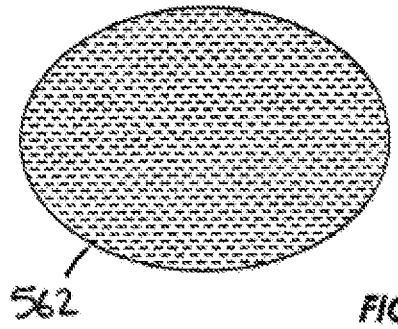
FIGS. 34A-D are exemplary spray patterns applied to a surface using the spray gun system constructed in accordance with the principles of the present invention.
Figure 34B:
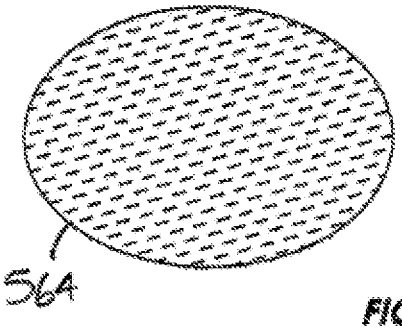
Figure 34C:
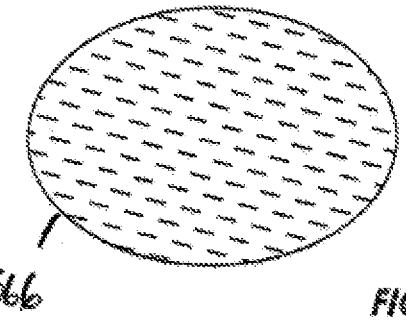
Figure 34D:
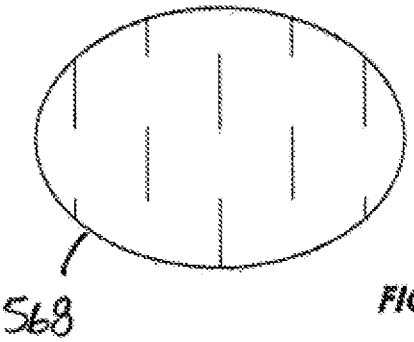
Figure 33:
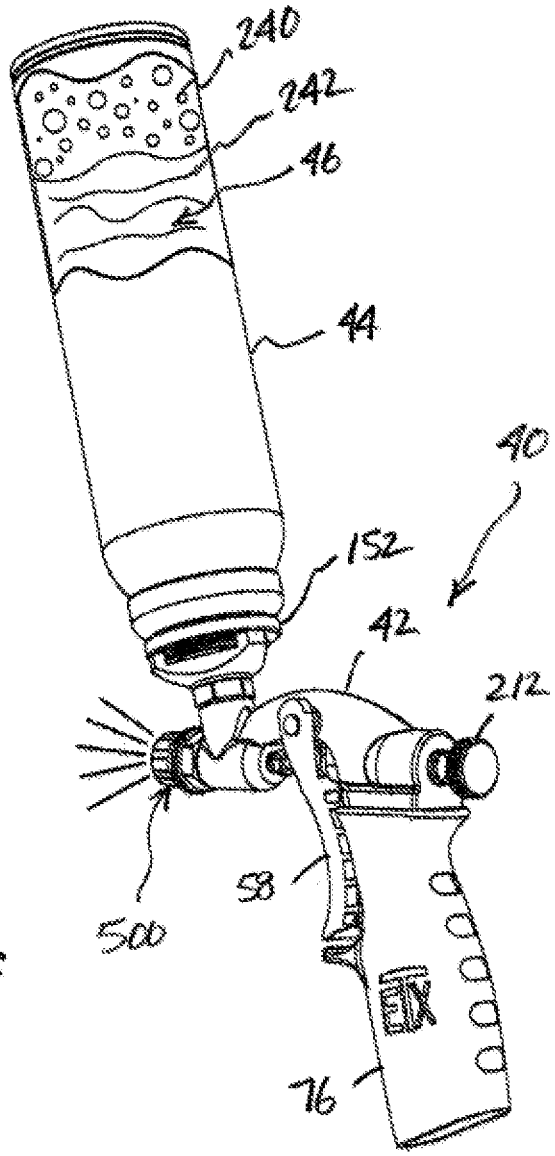
FIG. 33 is a similar view to FIG. 14 with the variable spray tip mounted to the spray gun apparatus.
Figure 35:
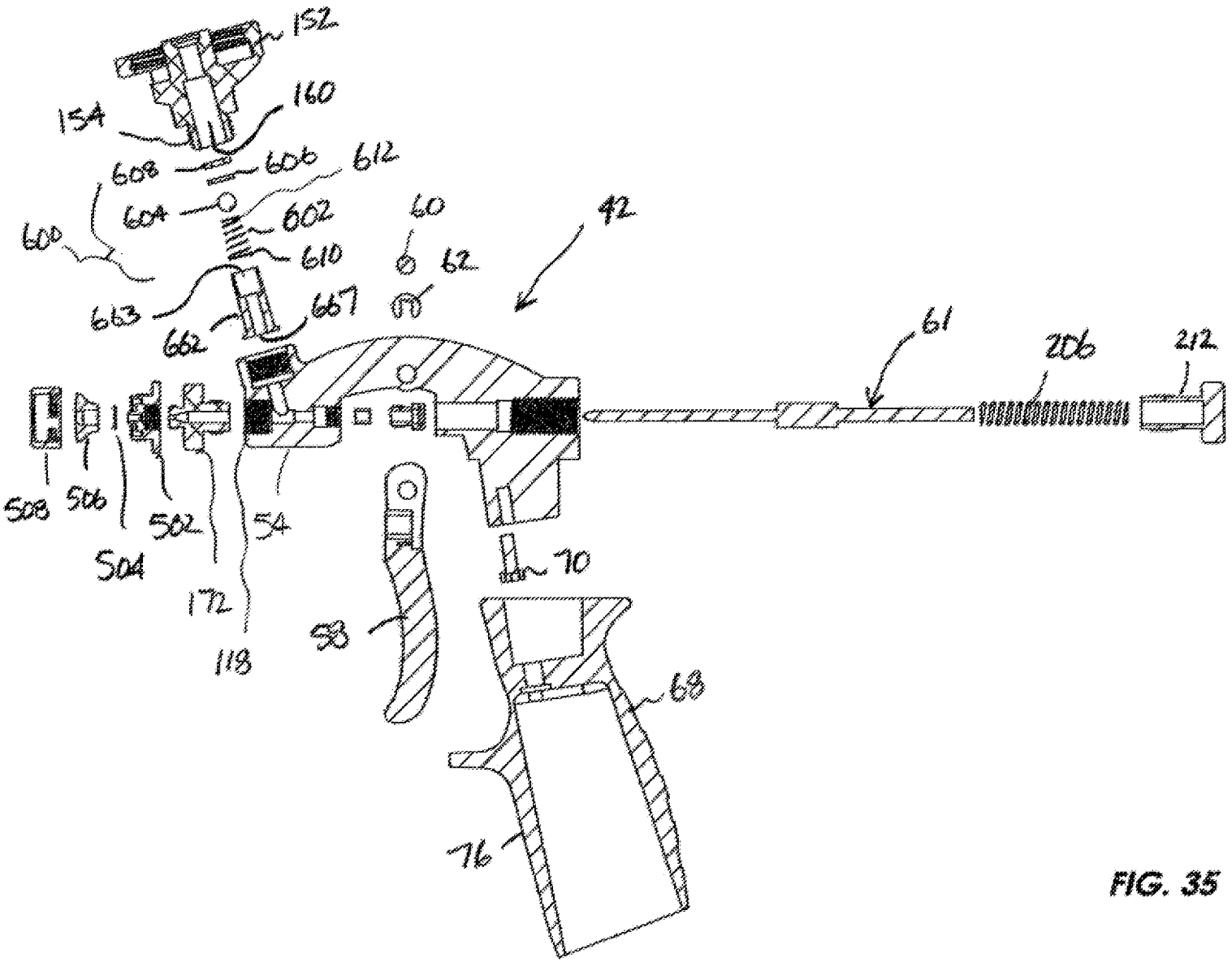
FIG. 35 is a similar view to FIG. 9A with a check valve element.

With the assembled variable spray tip 500, the user may then thread the internal threads 522 of the adapter mounting section 502 of the variable spray tip 500 onto the threaded post 178 of the spray tip adapter 172 as shown in FIGS. 32-33. It will be appreciated that the variable spray tip 500 may be assembled onto the spray tip adapter 172 instead of being pre-assembled before releasably securing thereto. The variable spray tip 500 extends the spray flow path from the outer orifice 180 (FIG. 13) of the spray tip adapter 172 and through the variable spray tip 500 to exit at the spraying opening 549 to allow sprayable substances to exit the spray gun 42 in a spray pattern to cover a surface the spray gun is directed toward and within range of the spray dispersion.

In use, assuming the variable spray tip 500 has been assembled and releasably threaded or otherwise secured to the spray tip adapter 172 as shown in FIG. 33, the user may rotate the adjustment element 508 between a first position wherein the adjustment element is threaded onto the adapter mounting section 502 so as to make contact with the wings 547 of the spray profile control element 506 without deforming the outer surface 544 (FIG. 28B), then the opening 549 is at its minimize size or diameter and will typically emit a spray in a fine mist preferred for particular applications of the sprayable material. With one or more partial or complete rotations of the adjustment element 508 relative to the adapter mounting section 502, the retention flange 558 forces the wings 547 of the spray profile control element rearwardly and inwardly toward adapter mounting section 502 as shown in FIG. 28F. This in turn creates a larger central bulge 545 which further widens the spray opening 549. A wider spray opening 549 as shown in FIGS. 28E-28F results in a less fine (less atomized or coarser) spray dispersion pattern relative to a smaller spray opening 549 shown in FIGS. 28A-28D). As the adjustment element 508 may be rotated from a first position with the spray opening 549 at a minimum diameter to a second position with the spray opening 549 at a maximum diameter, and any position therebetween, allowing for a continuous (or infinitely variable) spray profile spectrum between one extreme and another. Thus, it will be appreciated that a large variety of spray dispersion patterns may be achieved simply by rotating the adjustment element 508 in one direction or another relative to the adapter mounting section 502 to alter the shape of the throughbore or profile of the spray profile control element 506 and especially alter the shape or profile of the spray opening 549. The circular recess 558 leaves a space 559 in which the wings 549 may deform back and forth as the spray adjustment element 508 is rotated back and forth along the adapter mounting section 502. The flow directing tip 514 may also interact with the interior wall surfaces of the spray profile control element as the spray profile control element is being compressed and deformed by the spray adjustment element to alter the profile of the spray opening 549 and assist in widening the spray opening 549 as well. At a minimum, the area around the spray opening 549, wings 547, and outward facing surface 546 of the spray profile control element are deformable and resilient.

Turning now to FIGS. 29A-D, a variety of spray patterns are shown. In FIG. 29A, for example, spray pattern 562 results from a fine mist when the adjustment element 508 is in the outermost position (for example, as shown in FIGS. 28A-B) and the spray opening 549 has the most narrow diameter. With the adjustment element at a first intermediate position but closer to the fine mist position, the spray opening 549 has a wider diameter than the fine mist diameter and still results in a substantially fine spray pattern 564, although less fine than the fine mist spray pattern 562. With the adjustment element at a second intermediate position but closer to the coarse spray position, the spray opening 549 has a wider diameter than the diameter of the spray opening 549 with the adjustment element 508 at the first intermediate position resulting in a spray pattern 566 that is growing coarser. With the adjustment element at the innermost position (for example, as shown in FIGS. 28E-F) and the spray opening 549 having its widest diameter, the spray pattern 568 is coarse or at least noticeably less fine when applied to a surface. A finer spray pattern or mist may be preferred for less viscous fluids or where the application of the sprayable substance against the desired surface requires a more even appearance or even dispersion, such as when spraying paint, lacquer, or urethane requiring a more atomized spray. On the other hand, a less fine pattern may be preferred for more viscous fluids or where the application of the sprayable substance against the desired surface requires more sprayable substance for coverage or appearance preferences, such as when spraying drywall texture materials. Adjustment element positions in between may be useful when spraying orange peel texture patterns for example.

It will be appreciated that the variable spray tip 500 may be used alone or in conjunction with the variable needle valve 61 (FIGS. 33, 35A,35B) position to vary the spray dispersion quality. By squeezing the trigger and varying the adjustment element 508, a wide variety of spray dispersion patterns may be obtained using a single spray tip. For example, if a fine mist is desired for sprayable substances such as paint, lacquer, urethanes, or thinner, the adjustment element 508 may be rotated to its outermost position resulting in a fine mist. Where a thicker application, such as drywall texture, is required, the user may rotate the adjustment element closer to the adapter mounting section 502 to deform the spray profile control element 506 enlarging the outer aperture 549 more to accommodate a more dense spray compared to the fine spray created when the adjustment element is rotated further away from the adapter mounting section 502. Alternatively, the spray adjustment element may be constructed to slide along adapter mounting section by removing the complementary threads and incorporating a telescopic fit between the two components. An outer stop may be used to inhibit the spray adjustment element from being forced off the adapter mounting section under pressure from the spraying force.

Other Alternative Embodiments, Modifications, and Appreciations

It will be appreciated that cosmetic and finishing projects are more easily performed using the portable handheld gun/cartridge assembly 40. Once a cartridge 44 is attached, the user merely needs to point the nozzle 172 at the desired surface 48 and squeeze the trigger 58 moving the gun 42 over the surface needing touch up or repair to disperse an even pattern. This saves considerable time for setup and cleanup over a large commercial hopper device. The self-contained construction also allows for considerable freedom of movement. The use of a single cartridge holding both the propellant and the sprayable substance avoids the expense of dual cartridge constructions and associated dual plumbing. The cartridges are preferably disposable and/or recyclable. Since the sprayable substance 46 flows through a minimal portion of the gun and only contacts a portion of the needle valve 61 and spray tip adapter 172, cleanup, if necessary, is limited to those parts and possibly the cartridge seat 152. The spray tip adapter 172 is easily removed by turning the hex section and unscrewing the nozzle or sliding it out of the gun barrel 54. Considering the alternatives of using a large commercial hopper with a compressor or loading a mud into a drywall pan and applying mud manually using a blade or mud hawk or trowel, the present invention is clearly an improvement with respect to speed, cleanup, and control, especially for do-it-yourself home repair enthusiasts or commercial contractors in need of speed for smaller scale restoration jobs or other touchups.

In addition to the interchangeable spray tip adapters and spray tip protectors discussed above, it will be appreciated that a single spray tip nozzle with a plurality of outlet configurations that may be rotated into alignment with the spray outlet 110 may also be used as one of ordinary skill in the art familiar with conventional garden hose sprayers would understand.

It will be appreciated that while an upside down, dip tube free cartridge 44 is disclosed for mounting on a top side gun collar and that this configuration provides a better construction for using up all the contents of the cartridge, the gun collar may also be located alternatively on the bottom of the barrel for use with a pressure vessel having a dip tube and the flow channel modified accordingly as well and may be preferred for at least some applications.

Turning now to FIGS. 35A-B, wherein many of the like components are like numbered, one modification to the spray gun system 40 is the introduction of a one-way check valve assembly, generally designated 600, disposed within the cartridge seat 152, captured between the threaded post 154 of the cartridge seat and the cartridge seat coupling section 148, or within the cartridge seat coupling section 148 to inhibit flow back of sprayable contents that have entered the spray gun apparatus 42 toward the cartridge 44 and out through the cartridge seat 152. The check valve assembly includes a spring 602, a ball 604, a gasket 606, and a ball seat 608. A wider end 610 of the spring is loaded into a spring seat 663 within the cartridge seat seal 662 to contact the bottom shoulder 665 atop a reduced diameter through-bore section 667. A narrower end 612 of the spring is dimensioned to restrict the ball from passing through the internal path of the spring. The ball is a conventional ball bearing constructed of a suitable hard material. The gasket 606 is a compressible ring to cushion a portion of the ball against the ball seat 608 that is dimensioned to prevent the ball from passing through and form a useful seal. In one state, the ball compresses the gasket against the ball seat under a biasing force from the spring to prevent the sprayable contents from backflowing into the cartridge seat 152 as when may occur when removing the cartridge 44 from the spray gun apparatus 42. On the other hand, when the pressure from the cartridge 44 exceeds the compressive force of the spring, the ball is moved out of the ball seat 608 toward cartridge seat seal 162 allowing for the sprayable contents from the cartridge to enter the spray gun apparatus 42 through the cartridge seat seal 662. It will be appreciated that this auxiliary check valve 600 inhibits sprayable contents from exiting the spray gun body and into the cartridge seat as the cartridge is removed to reduce the likelihood of contaminating the cartridge seat and cartridge engagement surfaces so as not to foul future cartridge installations.

It will be appreciated that as used herein, the term "spray profile" may refer to the shape of an outlet, whether fixed or variable, or the shape of the sprayable contents or material exiting an outlet resulting in a particular spray pattern onto a surface. For example, an outlet with a particular spray profile may produce a spray pattern such as a streaming, mist, coarse, lumpy, narrow, shower, light, heavy, center, flat, droplet, drip, cone, shower, jet, soaker, rinse or wide spray pattern onto a surface.

Certain numerical ranges, capacities, and ratios have been mentioned in this description but are meant to be exemplary in nature and non-limiting.

Certain objects and advantages of the invention are described herein. Of course, it is to be understood that not necessarily all such objects or advantages may be achieved in accordance with any particular embodiment of the invention. Thus, for example, those skilled in the art will recognized that the invention may be embodied or carried out in a manner that achieves or optimizes one advantage or group of advantages as taught herein without necessarily achieving other objects or advantages as may be taught or suggested herein.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

What is claimed is:

1. A self-contained, portable, pressurized spray gun system for applying a sprayable substance to a surface comprising:

a spray gun body having a handle and a main barrel with an upper surface, the main barrel defining a passageway connecting an inlet port to a spray outlet defining an expanding spray profile;

a cartridge seat projecting from the upper surface of the main barrel and having a bore in communication with the passageway of the main barrel;

a single spray valve projecting at least partially through the main barrel of the spray gun body and constructed to travel between a first position projecting into and sealing off the spray outlet while leaving the remainder of the passageway open and a second position withdrawn from and at least partially opening the spray outlet;

a single cartridge including a release valve sealing off a single cartridge opening, the cartridge being pre-filled and pre-pressurized with a volume of sprayable material and a propellant prior to releasably coupling the cartridge to the cartridge seat with the release valve being constructed to open and allow at least a portion of the sprayable material to enter the passageway through the bore of the cartridge seat under a combined pressure and gravity feed to load a volume of sprayable material proximate an outer end of the spray outlet with the cartridge releasably coupled to the cartridge seat in an inverted orientation; and a trigger coupled to the spray valve and constructed to transition the spray valve between the first position and the second position allowing at least a portion of the sprayable material proximate the spray outlet to spray out through the spray outlet and expand outwardly through the expanding spray profile to produce a spray pattern on the surface.

2. The spray gun system of claim 1 further comprising:

a mounting collar on the cartridge releasably engaging the cartridge seat.

3. The spray gun system of claim 1 wherein:

the cartridge is tilted forward with the upper end of the inverted cartridge forward of the lower end of the cartridge when the spray gun body is upright.

4. The spray gun system of claim 1 wherein:

the cartridge seat includes at least one slot; and the mounting collar includes at least one boss constructed to slidably engage the at least one slot of the cartridge to releasably couple the cartridge to the spray gun body and open the release valve.

5. The spray gun system of claim 1 further comprising:

a variable spray tip releasably engaged with the spray gun body and including a throughbore in communication with the spray outlet, the variable spray tip including an adjustment element constructed to alter a spray profile through which the sprayable material of the cartridge may be sprayed out into one or more spray patterns depending on the position of the spray adjustment element to form a desired spray pattern on the surface.

6. The spray gun system of claim 5 wherein:

the adjustment element is constructed to rotate to vary the spray profile.

7. The spray gun system of claim 5 wherein:

the variable spray tip includes a resilient spray profile control element with a circular perimeter constructed to deform as the spray adjustment element is rotated toward the spray gun body and return substantially toward an original shape as the spray adjustment element is rotated away from the spray gun body.

8. The spray gun system of claim 5 wherein:

the variable spray tip includes an adapter mounting section constructed to releasably engage the spray gun body.

9. The spray gun system of claim 5 wherein:

the spray profile varies along a continuous spectrum depending on the rotational position of the adjustment element from a first extreme position to a second extreme position.

10. The spray gun system of claim 1 further comprising:

a spray tip adapter releasably engaged with the main barrel of the spray gun body and providing the spray outlet.

11. The spray gun system of claim 10 further comprising:
a spray tip releasably engaged with the spray tip adapter and including a throughbore in communication with the spray outlet with at least a portion of the throughbore providing an expanding conical spray profile through which the contents of the cartridge may be sprayed out into an expanding spray pattern on the surface.

12. The spray gun system of claim 11 wherein:
the throughbore of the spray tip is rifled.

13. The spray gun system of claim 11 wherein:
the outer surface of spray tip includes a knurled section.

14. The spray gun system of claim 11 wherein:
the spray tip includes a spray profile constructed to spray the sprayable material in a first desired pattern on a surface or joint when the trigger is squeezed to a first intermediate point.

15. The spray gun system of claim 11 wherein:
the spray tip includes an outlet spray profile constructed to spray the sprayable material in a second desired pattern on a surface or joint when the trigger is squeezed to a second intermediate point.

16. The spray gun system of claim 10 wherein:
the length of the spray tip adapter is shorter than the diameter of the spray tip adapter.

17. The spray gun system of claim 1 wherein:
the spray valve is a needle valve with an elongated body and a tapering tip constructed to close off the spray outlet when at least partially nested therein.

18. The spray gun system of claim 1 wherein:
at least a portion of the spray outlet tapers inwardly and then transitions to a cylindrical portion at its outermost end.

19. The spray gun system of claim 1 wherein:
the outer end of the single spray valve includes a first tapering section transitioning to a second tapering section with the first tapering section sealing off the spray outlet when disposed therein and the second tapering section cooperating with a spray outlet profile to define a first spray pattern exiting the spray outlet.

20. The spray gun system of claim 1 wherein:
the sprayable material is maintained under pressure proximate the spray outlet when the cartridge is releasably engaged with the cartridge seat until the cartridge is emptied of sprayable material.

21. The spray gun system of claim 1 further including:
a second cartridge pre-filled and pre-pressurized with a cleaning solvent, the second cartridge being swappable with the pre-filled and pre-pressurized cartridge and constructed to direct the cleaning solvent through the passageway of the main barrel under pressure to force substantially all of a residual sprayable material from the passageway out through the spray outlet.

22. The spray gun system of claim 1 wherein:
the spray outlet has an expanding spray profile with a cylindrical section transitioning to an expanding conical section at an outermost extent of the spray outlet.

23. The spray gun system of claim 1 wherein:
the spray outlet has an expanding spray profile with an expanding conical section terminating in a narrow slit at an outermost extent of the spray outlet.

24. The spray gun system of claim 1 wherein:
the spray outlet has an expanding spray profile with a cylindrical section with a first diameter terminating in a concave region with a larger diameter than the first diameter at an outermost extent of the spray outlet.

25. The spray gun system of claim 1 wherein:
the spray outlet has a concave outermost surface.

26. The spray gun system of claim 1 wherein:
the spray outlet has a flat outermost surface.

27. The spray gun system of claim 1 wherein:
the spray outlet has an expanding spray profile with an inner bullet nosed chamber transitioning to an expanding cone section at an outermost extent of the spray outlet.

28. The spray gun system as set forth in claim 1 wherein:
the sprayable material is selected from a group consisting of an oil based substance or a urethane based substance.

29. The spray gun system as set forth in claim 1 wherein:
the sprayable material is a cleaning product.

30. The spray gun system as set forth in claim 1 wherein:
the sprayable material is a starter fluid.

31. The spray gun system as set forth in claim 1 wherein:
the sprayable material is selected from a group consisting of a paint mixture, a paint thinning product, a stain, or a sealer.

32. The spray gun system as set forth in claim 1 wherein:
the sprayable material is an adhesive.

33. The spray gun system as set forth in claim 1 wherein:
the sprayable material is selected from a group consisting of a pesticide, herbicide, insecticide, insect growth regulator, nematicide, termiticide, molluscicide, piscicide, avicide, rodenticide, predacide, bactericide, insect repellent, animal repellent, antimicrobial, fungicide, disinfectant, or sanitizer.

34. The spray gun system as set forth in claim 1 wherein:
the sprayable material is a non-skid coating.

35. The spray gun system as set forth in claim 1 wherein:
the sprayable material is a mold remediator.

36. The spray gun system as set forth in claim 1 wherein:
the sprayable material is a concrete overlay.

37. The spray gun system as set forth in claim 1 wherein:
the sprayable material is a deicer.

38. A self-contained, portable, pressurized spray gun system for applying a sprayable substance to a surface comprising:
a spray gun body having a handle and a main barrel with an upper surface, the main barrel defining a passageway connecting an inlet port to a spray outlet;
a cartridge seat projecting from the upper surface of the main barrel and having a bore in communication with the passageway of the main barrel;
a single spray valve projecting at least partially through the main barrel of the spray gun body and constructed to travel between a first position projecting into and sealing off the spray outlet while leaving the remainder of the passageway open and a second position withdrawn from and at least partially opening the spray outlet;
a single cartridge including a release valve sealing off a single cartridge opening, the cartridge being pre-filled and pre-pressurized with a volume of sprayable material and a propellant prior to releasably coupling the cartridge to the cartridge seat with the release valve being constructed to open and allow at least a portion of the sprayable material to enter the passageway through the bore of the cartridge seat under a combined pressure and gravity feed to load a volume of sprayable material proximate an outer end of the spray outlet with the cartridge releasably coupled to the cartridge seat in an inverted orientation;
a variable spray tip releasably engaged with the spray gun body and introducing a variable spray outlet profile to the spray outlet, the variable spray tip including an adjustment element constructed to alter the variable spray outlet profile through which the sprayable material of the cartridge may be sprayed out into one or more spray patterns depending on the position of the adjustment element to form a desired spray pattern on the surface; and a trigger coupled to the spray valve and constructed to transition the spray valve between the first position and the second position allowing at least a portion of the sprayable material proximate the spray outlet to spray out through the variable spray outlet profile and expand to produce a spray pattern on the surface.

* * * * *